US010544938B2

(12) United States Patent
Gaudioso

(10) Patent No.: US 10,544,938 B2
(45) Date of Patent: Jan. 28, 2020

(54) AUTOMATIC FLAME EXTINGUISHER

(71) Applicant: Easy Life Brands LLC, Woodland Hills, CA (US)

(72) Inventor: Shahesta Gaudioso, Northridge, CA (US)

(73) Assignee: Easy Life Brands LLC, Woodland Hills, CA (US)

( * ) Notice: Subject to any disclaimer, the term of this patent is extended or adjusted under 35 U.S.C. 154(b) by 214 days.

(21) Appl. No.: 15/663,615

(22) Filed: Jul. 28, 2017

(65) Prior Publication Data

US 2018/0031236 A1 Feb. 1, 2018

Related U.S. Application Data

(60) Provisional application No. 62/368,049, filed on Jul. 28, 2016.

(51) Int. Cl.

| | |
|---|---|
| ***F23Q 25/00*** | (2006.01) |
| ***F23N 5/20*** | (2006.01) |
| *F21V 35/00* | (2006.01) |
| *F23N 5/00* | (2006.01) |

(52) U.S. Cl.

CPC ..... *F23Q 25/00* (2013.01); *F23N 5/20* (2013.01); *F21V 35/00* (2013.01); *F23N 5/00* (2013.01)

(58) Field of Classification Search

CPC . F23Q 25/00; F23N 5/245; F23N 5/22; F23D 3/18

USPC ..... 431/133, 289, 144, 146, 34; 220/813, 220/812, 816, 817, 818, 819, 811, 826, 220/822, 820, 212

See application file for complete search history.

(56) References Cited

U.S. PATENT DOCUMENTS

| | | | | |
|---|---|---|---|---|
| 4,915,913 | A * | 4/1990 | Williams | A61L 2/26 220/324 |
| 4,941,588 | A * | 7/1990 | Flider | B65D 45/20 220/302 |
| 5,149,153 | A | 9/1992 | Drewry et al. | |
| 5,248,259 | A * | 9/1993 | Naito | B60R 16/005 439/188 |
| 5,899,685 | A | 5/1999 | Thigpen | |
| 6,494,708 | B1 * | 12/2002 | Hart | F21V 35/00 431/146 |
| 6,572,365 | B1 * | 6/2003 | Byxbe | F23Q 25/00 431/289 |

(Continued)

FOREIGN PATENT DOCUMENTS

KR 101703325 B1 2/2017

*Primary Examiner* — Avinash A Savani
*Assistant Examiner* — Rabeeul I Zuberi
(74) *Attorney, Agent, or Firm* — Lowry Blixseth APC; Scott M. Lowry

(57) ABSTRACT

The automatic flame extinguisher may include a base for selectively positioning the automatic flame extinguisher in relation to a candle. A lid coupled to the base may selectively rotate about a pivot between a first open position that allows a burning wick of the candle to receive sufficient ambient oxygen to continue burning and a second closed position to extinguish the burning wick of the candle. In this respect, a timer may include a clock for selectively activating the pivot to reposition the lid from the first open position to the second closed position after the clock reaches a threshold operation time.

27 Claims, 26 Drawing Sheets

(56) References Cited

U.S. PATENT DOCUMENTS

| | | | | |
|---|---|---|---|---|
| 7,708,137 | B1 * | 5/2010 | Rowley, Jr. | B65D 7/06 206/223 |
| 2001/0029696 | A1 | 10/2001 | DeStefano et al. | |
| 2005/0002188 | A1 | 1/2005 | Bucher et al. | |
| 2007/0031769 | A1 | 2/2007 | Burton et al. | |
| 2007/0072140 | A1 * | 3/2007 | Almodovar | F23D 3/16 431/289 |
| 2007/0128561 | A1 | 6/2007 | Hart | |
| 2007/0184395 | A1 | 8/2007 | Taylor | |
| 2007/0236923 | A1 * | 10/2007 | Fan | F21S 9/037 362/183 |
| 2009/0029304 | A1 * | 1/2009 | Steinmann | F21V 21/12 431/289 |
| 2009/0068607 | A1 * | 3/2009 | Konkle | F23D 3/16 431/291 |
| 2010/0075265 | A1 | 3/2010 | Quinn et al. | |
| 2011/0266296 | A1 * | 11/2011 | Curotto | B65F 1/1638 220/810 |
| 2014/0197169 | A1 * | 7/2014 | Carlile | B65D 47/20 220/254.1 |
| 2015/0001219 | A1 * | 1/2015 | Hess | B65F 1/06 220/263 |
| 2015/0282587 | A1 * | 10/2015 | Earl | A45D 33/18 220/288 |

* cited by examiner

AUTOMATIC FLAME EXTINGUISHER

BACKGROUND OF THE INVENTION

The present invention generally relates to automatic flame extinguishers. More specifically, the present invention relates to automatic candle flame extinguishers that include a lid automatically pivotable between an open position permitting burning of a candle flame and a closed position whereby the lid seals the candle thereby extinguishing the flame as a result of a lack of oxygen therein.

Candles are widely known in the art and may be formed by enclosing a thread within a wax-based material such as beeswax or paraffin. In this respect, the wax-based material may be formed into various different sizes, shapes, and designs during manufacture. After igniting an exposed end of the thread extending out from the wax-based material (e.g., generally the top), heat from the burning wick may liquefy the wax into a flammable fuel that allows the flame to continue to burn. In respect, candles may be designed to generate various light output, emit various aromas, disperse chemical agents (e.g., insect repellant), etc. as the flame burns the wax-based material underneath. The wick of the candle will generally continue to burn so long as there is enough of the wax-based material to liquefy and burn.

Additionally, candles may be used with various accessories, including candle holders, shades, toppers, trays, etc. that may serve aesthetic and/or functional purposes. As an example, candle holders may range from a simple flat dish for a single candle to an ornate multi-candle chandelier, depending on candle placement and use (e.g., candle size and/or desired light output). Despite the variety of candle holders known in the art designed for light-emitting purposes, aesthetic purposes, and/or aromatic qualities, one drawback is that no reliable mechanisms are known in the art to automatically extinguish a burning candle that may be forgotten. Unattended candle burning is certainly undesirable as it wastes the candle and may be a fire hazard.

Although, certain candle extinguishers are known in the art that may be used to manually snuff out candles while preventing contact burns and minimizing the unwanted spread of liquid wax that may result from rapidly forcing air over a burning wick, e.g., to blow out or extinguish the flame. Such candle extinguishers resemble cups mounted to the end of long rods to distance the user from the flame. The problem is that such extinguishers require direct user involvement. That is, candles inadvertently left burning (e.g., forgotten) will not extinguish on their own, thus leaving the hazardous flame exposed and unattended, as mentioned above.

There exists, therefore, a significant need in the art for an automatic flame extinguisher that includes a lid pivotable about a joint between a first open position permitting a candle flame to burn and a second closed position wherein the lid overlies the flame thereby extinguishing the flame, the lid being automatically pivotable between the first and second positions after a predetermined or preset duration. The present invention fulfills these needs and provides further related advantages.

SUMMARY OF THE INVENTION

One embodiment of the automatic flame extinguisher as disclosed herein includes a base for positioning the automatic flame extinguisher in relation to a candle and a lid coupled to the base about a pivot and being selectively positionable between a first open position and a second closed position to extinguish a burning wick of the candle. Moreover, the automatic flame extinguisher may include a timer that includes a clock for selectively activating the pivot to reposition the lid from the first open position to the second closed position after the clock reaches a threshold operation time. The pivot may include a revolute joint or a helical gear actuable by the timer in response to the clock reaching the threshold operation time. In one embodiment, each of the base, the lid, and the timer may be made from a flame resistant material or a heat insulative material to prevent burning. The base may also include a spring-loaded clip selectively attachable to the candle.

In another embodiment, the base may include an elongated container having a size and shape for select reception and retainment of the candle therein. Here, the elongated container may include an upper rim having a size and shape for selectively receiving the lid for seated reception thereon when the lid is in the second closed position. Additionally, the container and the lid may cooperate with one another to substantially close an interior of the container off from the atmosphere to starve the burning wick of oxygen. Once the oxygen content within the interior runs out, the flame burns out due to a lack of fuel.

The elongated container may also be a cylindrical container that includes a plurality of telescoping wall segments for selectively changing a height of the cylindrical container. Here, the automatic flame extinguisher may be compatible with a variety of candles that vary in height. Additionally, the plurality of telescoping wall segments may each include an upper segment selectively movable relative to a lower segment about a medial expansion plate. The cylindrical container may also include a plurality of curved wall segments with vertical subduction gaps in between respective adjacent curved wall segments. Each of the plurality of curved wall segments may be selectively slidable relative to one another in overlapping relationship about the respective subduction gaps for inward and/or outward radial translation to vary an internal diameter of the cylindrical container. The base may also include a plurality of movable platform blades each separately and articulably coupled to an adjustable inner rim of the base. A plurality of subduction gaps positioned generally between each of the plurality of movable platform blades may similarly permit selective sliding movement of adjacent movable platform blades relative to one another in an overlapping relationship. This way, the automatic flame extinguisher may be compatible for use with candles that vary in width. The lid may also include a plurality of movable lid blades, each separately and articulably coupled with a lid cap and movable relative to one another to vary a diameter of the lid.

In another aspect of the embodiments disclosed herein, the base may include an annular mounting ring having an upper surface generally complimentary with the lid for seated reception thereon and an internal channel having a size and shape for select compression fit engagement with an upper rim of a container retaining the candle.

The timer may include a hand-operable timer or an electronic timer operable via an externally accessible input. Moreover, the timer may include a display showing an elapsed time or the threshold operation time so the user knows when the automatic flame extinguisher will pivot the lid from the first open position to the second closed position to extinguish the candle flame. Here, the timer may also include a lid activation button that allows a user to manually or automatically selectively position the lid between the first open position and the second closed position. The timer may also be in communication with a sensor coupled with an indicator switch identifying whether the lid is in the first open position or the second closed position. In one embodiment, the indicator switch may include a first lead generally exposed underneath the lid and a second lead generally exposed thereunder and in non-contact relation relative thereto when the lid is in the first open position and in contact relation relative thereto when the lid is in the second closed position. In some embodiments, the second lead may generally couple with the base, a rim of a container housing the candle, a clip coupling the base to the rim of the container housing the candle, or an annular mounting ring. A remote controller may be communicatively coupled with the timer and in operable relation relative thereto, including allowing a user to remotely set the timer and/or identify whether the lid is in the first open position or the second closed position based on readings from the sensor coupled to the indicator switch. Here, the user may be able to remotely close the lid by way of the remote controller when the sensor identifies that the lid is still in the first open position.

In another embodiment, the lid may include an inner annular seal that includes a flexible material selectively form fitting to an upper rim of a container of the candle and cooperating therewith to seal the candle from atmosphere when the lid is in the second closed position. Here, the lid may further include a transparent cover generally positioned to an interior of the inner annular seal for viewing a wick of the candle when the lid is in the second closed position. In this embodiment, the user may be able to verify whether the burning wick has been extinguished by looking through the transparent cover into the interior of the candle container.

In another aspect of the embodiments disclosed herein, the automatic flame extinguisher may include a lock that retains the lid in the second closed position. In one embodiment, the lock may include a housing that retains a rotatable wheel coupled with an upwardly extending lever and a latch. The upwardly extending lever may extend into a position wherein it is actuable by the lid when the lid pivots from the first open position to the second closed position. As such, the lid may rotate the lever downwardly about the wheel coupled thereto, which causes the wheel to simultaneously rotate the latch into an overlying position relative to the lid to lock the lid in the second closed position. Releasing the lid from the locked position may require manually pivoting the latch off the lid, which then causes the lever to extend upwardly and push the lid back into the first open position.

The lid may also include a solar panel thereon for generating electrical energy to power the timer. In this respect, the pivot may also include a cam actuable by the timer in response to the clock reaching the threshold operation time. Here, the cam may move between a first disengaged position in non-contact relation relative to an actuation lever when the lid is in the first open position and an engaged position contacting the actuation lever to reposition the lid in the second closed position. The activation lever may be made from an electrically conductive material that selectively couples with an electrical contact triggering repositioning of the lid to the second closed position. In this embodiment, the electrical contact may be powered by the timer, such as by way of a battery, hardwire power source, or the solar panel.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
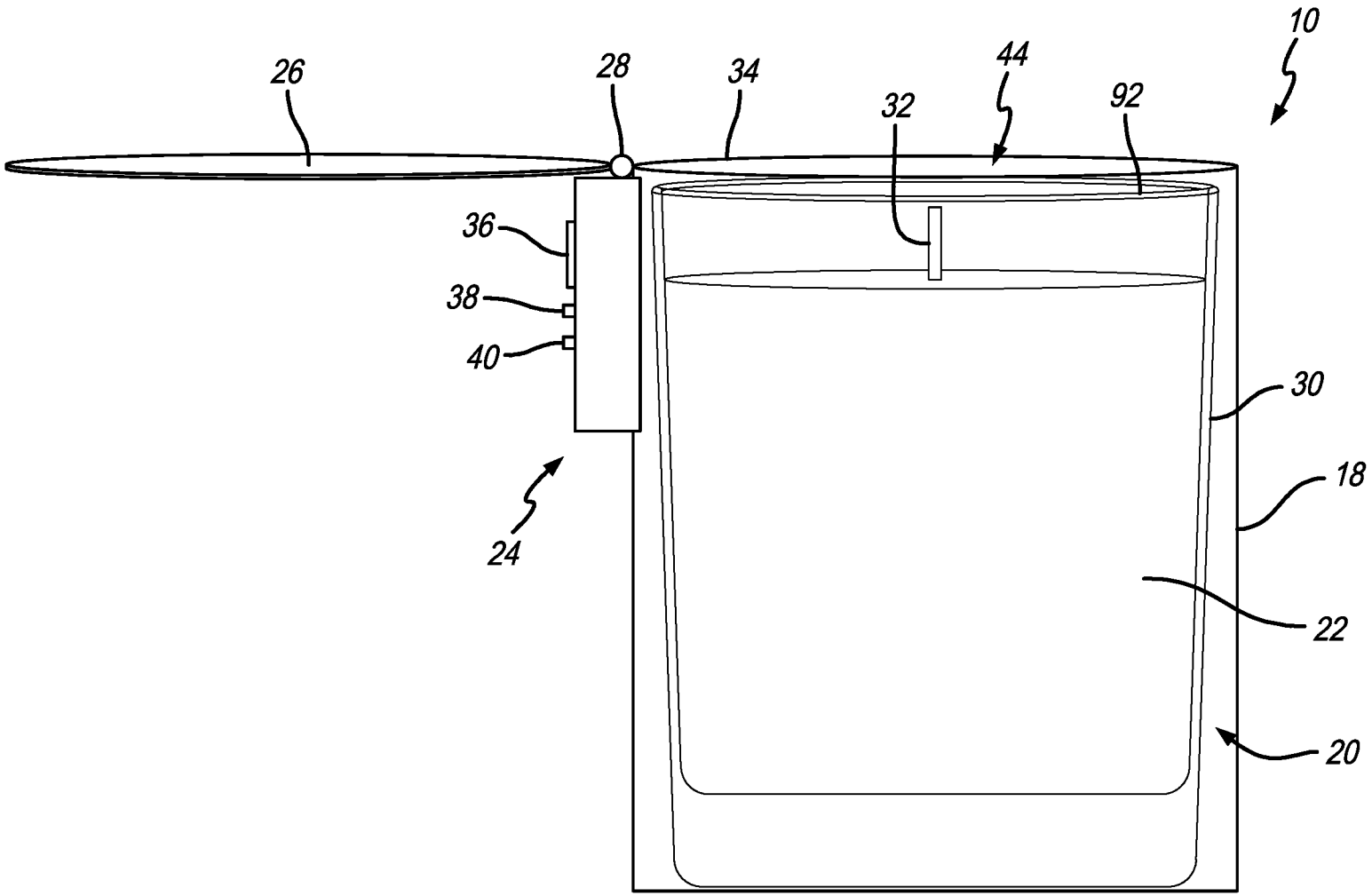
FIG. 1 is a perspective view of one embodiment of an automatic flame extinguisher having a pivotable lid coupled to a housing for selectively receiving and retaining a candle therein.
Figure 6:
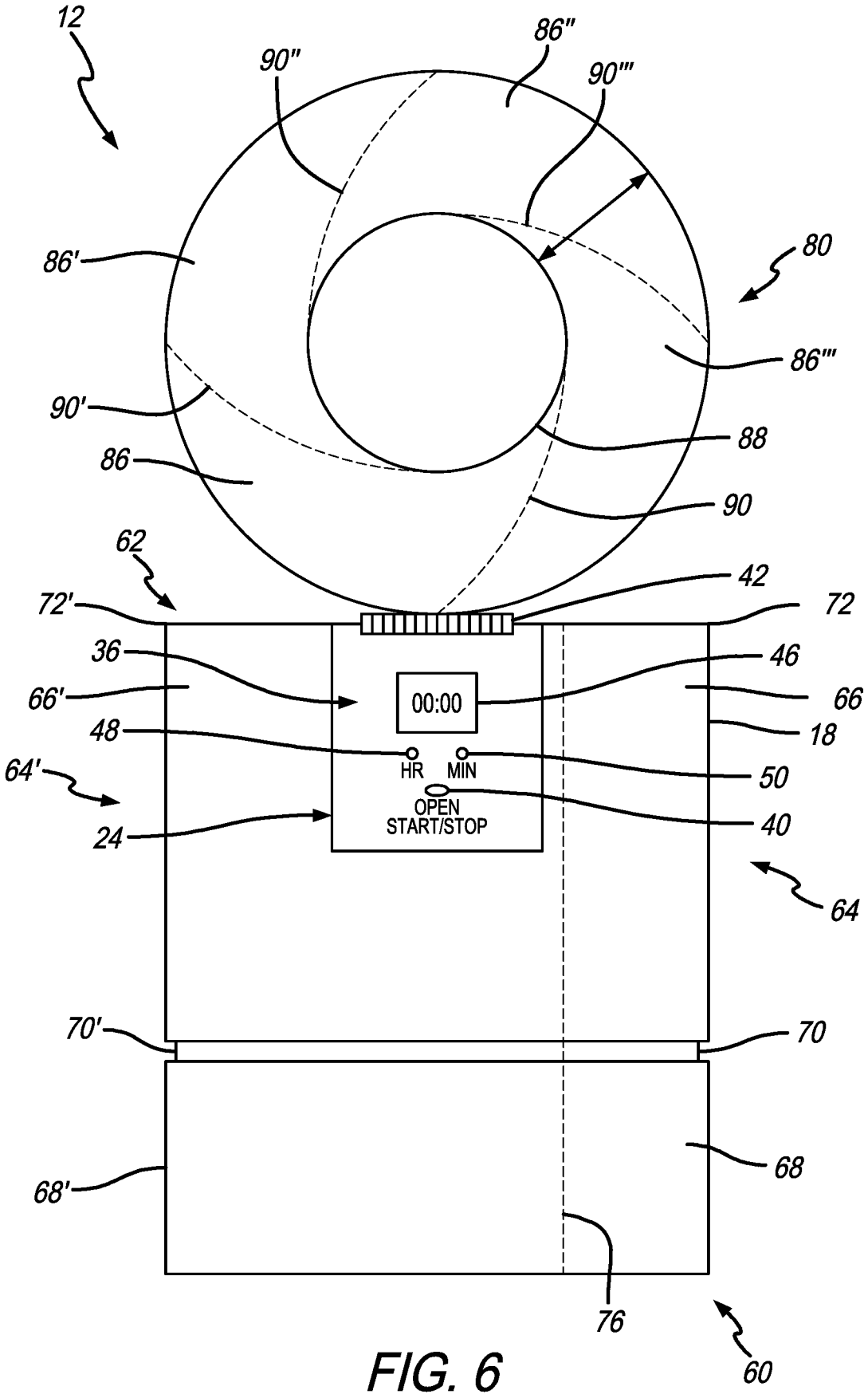
FIG. 6 is a front elevation view of an adjustable automatic flame extinguisher, including a diametrically adjustable housing and a diametrically adjustable lid.
Figure 7:
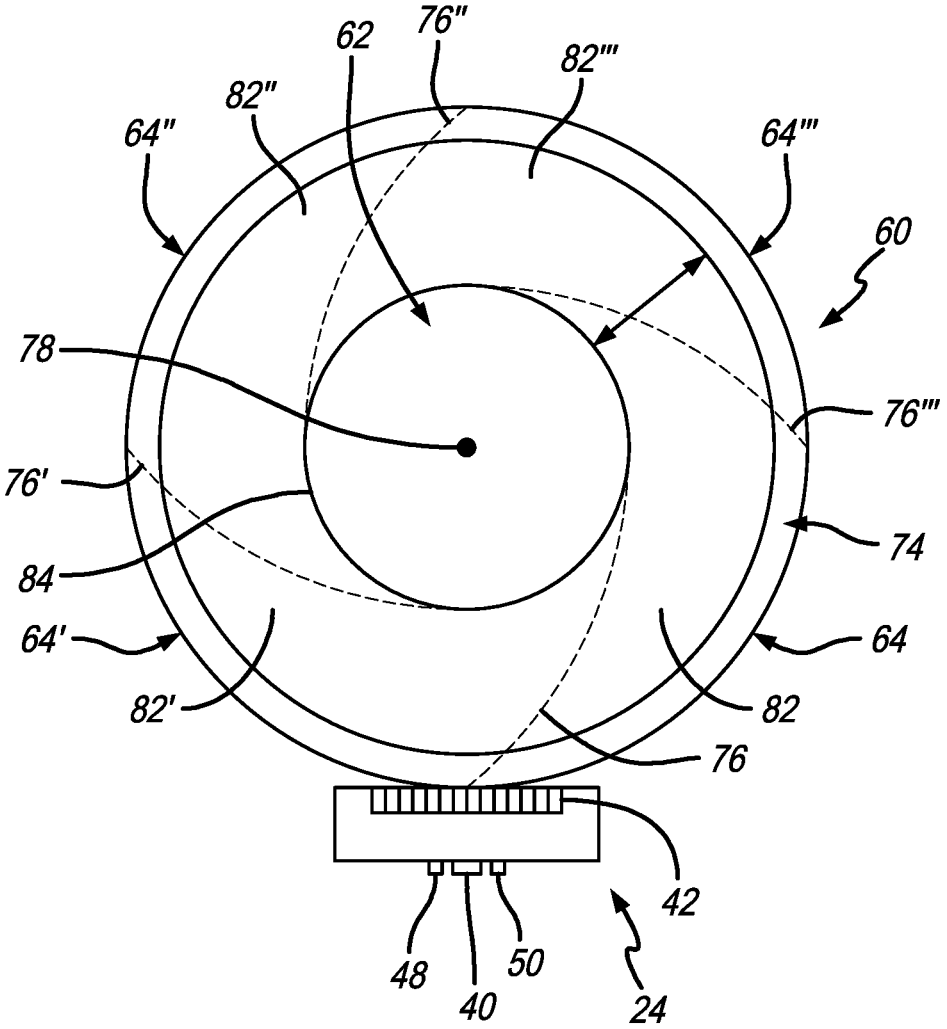
FIG. 7 is a top elevation view of the adjustable automatic flame extinguisher of FIG. 6 without the diametrically adjustable lid, further illustrating the diametrically adjustable housing having a set of movable blades.

As shown in the exemplary drawings for purposes of illustration, the present invention for an automatic flame extinguisher is generally referred to by the reference numeral 10 in FIGS. 1-4 and 12-15; as numeral 12 with respect to an adjustable automatic flame extinguisher in FIGS. 6-7; as numeral 14 with respect to a clip-on automatic flame extinguisher in FIGS. 8-9 and 16-17; and as numeral 16 with respect to an annularly-mounted automatic flame extinguisher in FIGS. 10-11 and 18-19. In one embodiment as shown in FIG. 1, the automatic flame extinguisher 10 may include a container-like housing 18 having an internal cavity 20 for holding a candle 22. Furthermore, the automatic flame extinguisher 10 may include a timer 24 coupled to the housing 18 and pivotally coupled to a lid 26 via a revolute joint 28. The housing 18 is illustrated in FIG. 1 as a cylindrical housing, but the housing 18 may alternatively be formed in a variety of other hollow shapes, such as a square, rectangle, prism, etc. The housing 18 may be made from a transparent flame resistant or retardant material such as glass, metal, ceramic, etc. Additionally, the exterior of the housing 18 may optionally be insulated from heat generated by the flame within the cavity 20, to facilitate handling. For example, the housing 18 itself may be made from an insulative material that prevents heat conduction; or the internal or external sidewalls of the housing 18 may include an additional insulative layer (not shown) to substantially reduce heat conduction to the exterior of the housing 18.

In the embodiment illustrated with respect to FIG. 1, the wax material of the candle 22 resides within a protective glass container 30 that may be placed within the cavity 20 of the housing 18 as shown. Alternatively, the wax material of the candle 22 may be poured directly into the interior of the cavity 20, wherein the candle 22 is basically integrally formed with the housing 18 of the automatic flame extinguisher 10. Here, the wax material may take on the same or similar shape as the housing 18 (e.g., cylindrical, prism, rectangular, etc.). In this embodiment, the wax material may occupy a portion of the cavity 20 or substantially the entire cavity 20. Additionally, the candle 22 may include an upwardly protruding and exposed wick 32 that burns during use.

The timer 24 is illustrated in FIGS. 1-4 and 6-9 as a rectangular box-shaped module secured to the exterior of the housing 18 adjacent a rim 34 and may be manually (e.g., hand-wound) or automatically motorized (e.g., a powered circuit). The timer 24 may be coupled to the revolute joint 28, and include a display 36, an input button 38, a lid activation button 40, and/or an internal actuator mechanism configured to pivot the revolute joint 28. The timer 24 may be formed from the same or similar fire resistant or retardant material as the housing 18, or the timer 24 may be formed from a different durable non-fire retardant material. The timer 24 may include a hatch panel that provides internal access to the internal actuator mechanism for maintenance and/or repairs. Alternatively, the timer 24 may be a removable module that selectively engages (e.g., snap-fit engagement) the exterior of the housing 18. In this embodiment, the timer 24 may selectively engage the revolute joint 28 when attached to the housing 18, and may selectively disengage the revolute joint 28 when removed therefrom. Here, the revolute joint 28 may be coupled directly to the housing 18, such as adjacent to or directly coupled with the rim 34.

The revolute joint 28 may be the articulable interface between the lid 26 and the internal actuator mechanism within the timer 24, and may be formed from a variety of durable materials (e.g. metal, plastic, or the like). In one embodiment, the revolute joint 28 may be a spring-loaded hinge capable of being locked in an open position by a locking mechanism associated with the actuator mechanism inside the timer 24. When the display 36 reaches "00:00", the actuator mechanism inside the timer 24 may release the locking mechanism, thereby activating the spring and allowing the revolute joint 28 to pivot the lid 26 from an open position (e.g., FIG. 1 or 2) to a closed position (e.g., FIG. 3). Alternatively, the revolute joint 28 may include an exterior helical gear 42 (e.g., as shown in FIGS. 4, 6, and 7) that couples to a complementary threaded gear of the internal actuator mechanism (e.g., a motorized timer) within the timer 24, to pivot the revolute joint 28. In this alternative embodiment, the timer 24 may also include an internal power source (e.g., a battery or wire line connection) to power the motorized internal actuator mechanism. In another embodiment, the revolute joint 28 may include a series of parallel axial indentations that translate rotation of a complementary cylindrical gear affixed to the internal motorized actuator mechanism within the timer 24.

Figure 2:
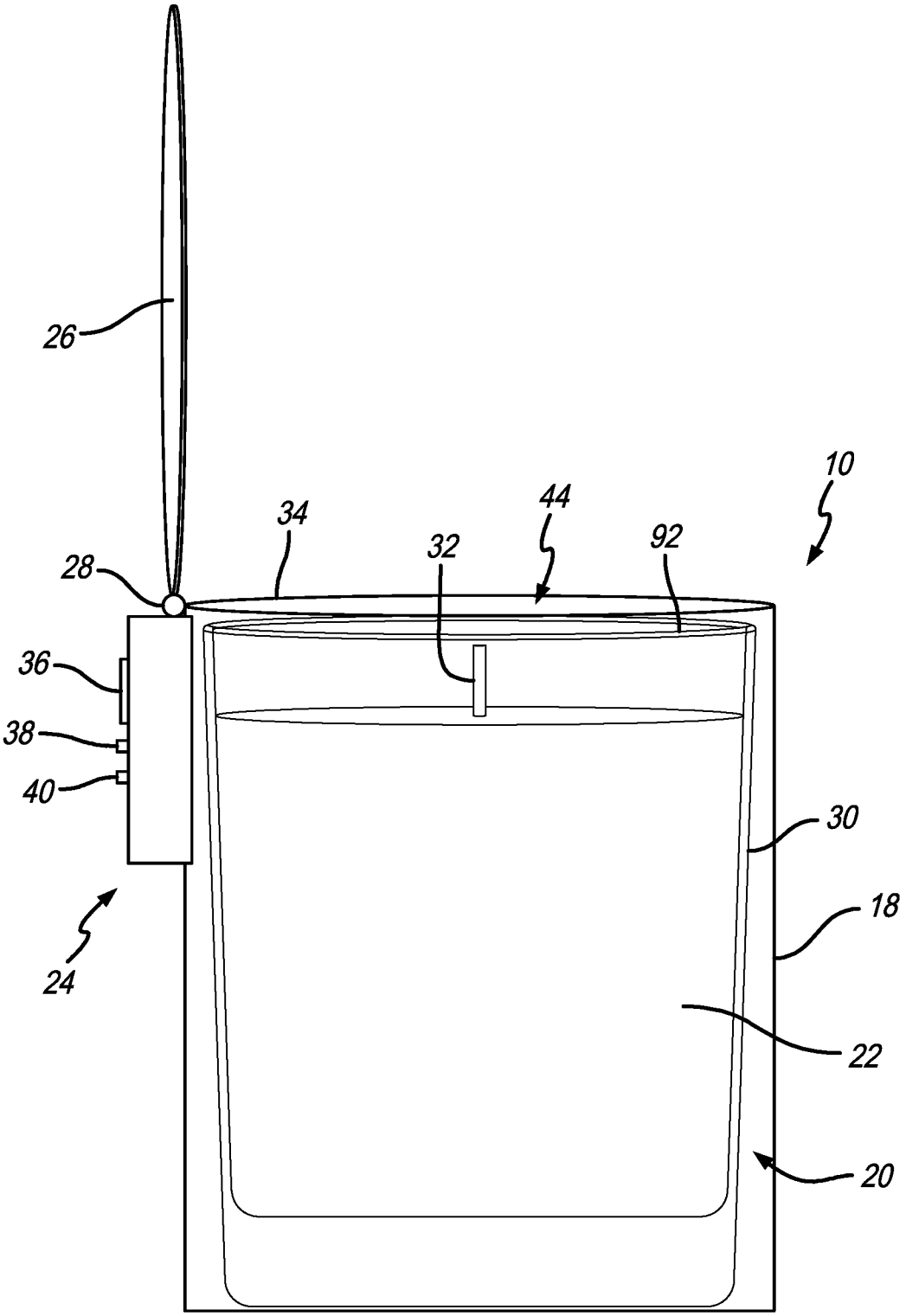
FIG. 2 is a perspective view of the automatic flame extinguisher of FIG. 1, further illustrating the pivotable lid in an open and generally upright vertical position.
Figure 3:
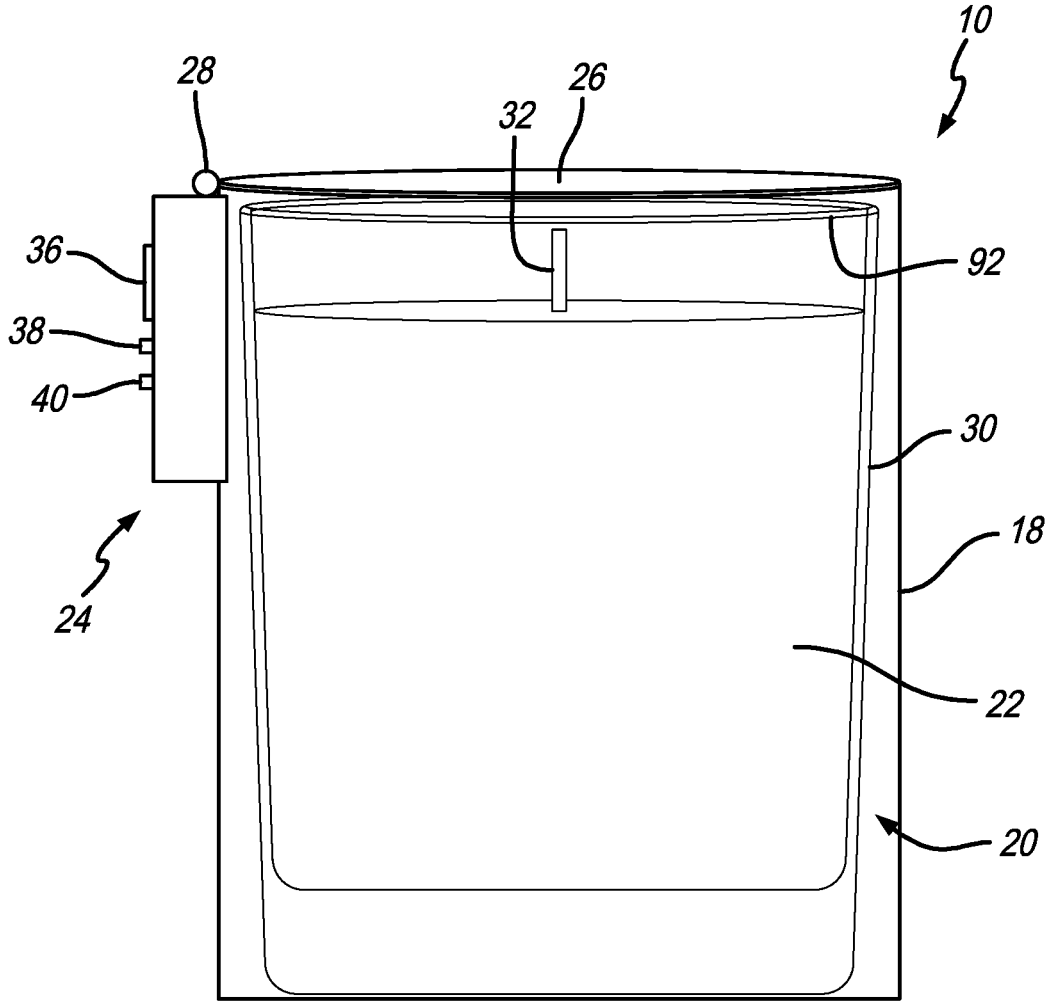
FIG. 3 is a perspective view of the automatic flame extinguisher of FIGS. 1-2, further illustrating the pivotable lid in a closed position sealing a wick inside the housing.
Figure 4:
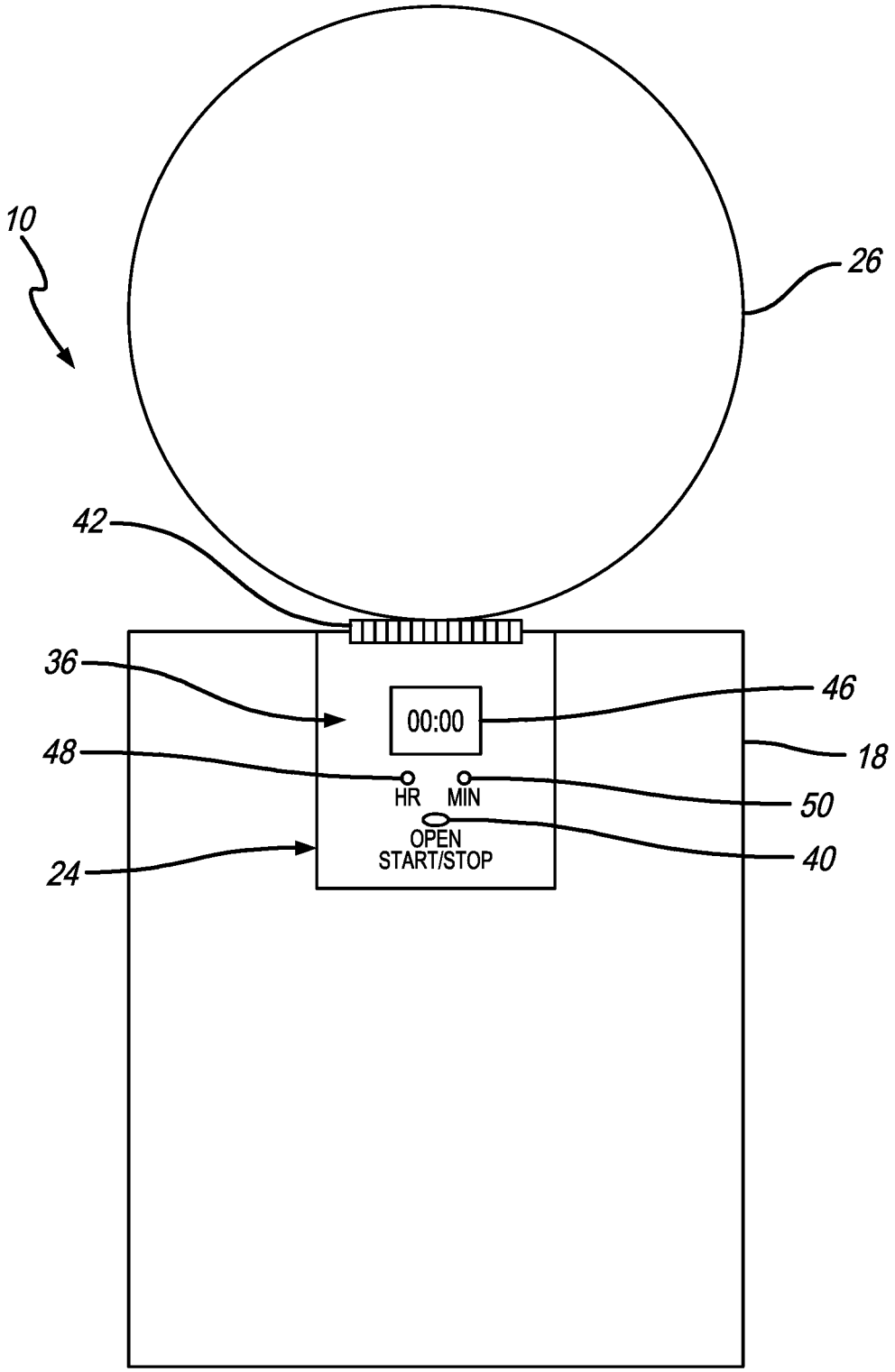
FIG. 4 is a front elevation view of the automatic flame extinguisher, further illustrating a timer having a display and multiple input buttons for operating the pivoting lid and specifying a duration the pivoting lid remains open before closing.

As shown in FIGS. 1-3, the lid 26 may couple to the revolute joint 28 and may be pivoted thereby between the open positions shown in FIG. 1 or 2 and the closed position shown in FIG. 3. Such opening and/or closing pivoting action may occur at a constant or variable speed, depending on the desired application. Alternatively, the input button 38 may permit selection of the desired speed the internal actuator mechanism opens and/or closes the lid 26. In this respect, the operational speed of the internal actuator mechanism may translate directly to the optional speeds of the revolute joint 28. The lid 26 in FIGS. 1-3 is circular in shape, but the lid 26 may alternatively be one of a variety of shapes (e.g. triangular, rectangular, hexagonal, or the like) so long as the lid 26 is of sufficient size to cover an upper opening 44 of the housing 18. In another embodiment, the lid 26 may be a domed hemispherical shape or some other three-dimensional shape having a large enough footprint to sufficiently cover the upper opening 44. The lid 26 may be made from a durable fire-proof material, such as the same or a similar material as the housing 18.

As shown in the progression from FIG. 1 to FIG. 3, the lid 26 may substantially close the upper opening 44 by pivoting about the revolute joint 28. As an example, the lid 26 may start pivoting movement from the substantially horizontal position shown in FIG. 1 or the substantially vertical position shown in FIG. 2. In the example of FIG. 2, the lid 26 may only need to pivot approximately ninety (90) degrees to close the upper opening 44, as shown in FIG. 3. When in the closed position, the lid 26 may seal around the rim 34, thus depriving the wick 32 of environmental oxygen outside the cavity 20. The seal formed between the lid 26 and the rim 34 may be non-airtight, but must still preclude enough oxygen from reaching the wick 32 when the lid 26 is in the closed position to starve the burning wick 32 of oxygen to cease combustion. The lid 26 may be lighter than the combined weight of the housing 18 and the timer 24 such that the lid 26 does not cause the automatic flame extinguisher 10 to move, shift, or tilt during pivoting movement.

In operation, a user may open the lid 26 (if not open already) either by pressing the lid activation button 40 or by physically rotating the lid 26 up and away from the rim 34. When in the open position (e.g., FIG. 1 or 2), the wick 32 is exposed and may be lit, and will burn while in the presence of oxygen. The user may set the duration the lid 26 will remain open by way of, e.g., the input button 38. The display 36 may provide a visual indication of the time remaining before the lid 26 will close, thereby extinguishing the burning wick 32. The input button 38 may be used to start, stop, or clear the timer 24. In an alternative embodiment, the timer 24 may function automatically after the lid 26 is pivoted open, thus obviating the need to program or use one or more of the input button 38 or the lid activation button 40. Once the duration shown on the display 36 reaches zero (e.g., "00:00"), the internal actuator mechanism may activate the revolute joint 28 to pivot the lid 26 from the open position (e.g., FIG. 1 or 2) to the closed position (e.g., FIG. 3). The speed with which the lid 26 pivots closed may depend on the pivoting speed of the revolute joint 28. In one embodiment, the lid 26 may close at a predetermined and fixed speed, while in an alternative embodiment, the lid 26 may close at an optional speed set by the user (e.g., accessible by way of the timer 24).

FIG. 4 illustrates another embodiment of the automatic flame extinguisher 10. In this respect, FIG. 4 more specifically illustrates the display 36 having a clock 46 (currently set to "00:00") along with an hour input button 48, a minute input button 50, and the lid activation button 40. The hour input button 48 may add and/or subtract hours to the clock 46 and the minute input button 50 may add and/or subtract minutes to the clock 46. The time on the clock 46 represents the duration the lid 26 will remain open, before the internal actuator mechanism activates to pivot the lid 26 closed. For example, when the display 36 reaches zero (i.e., "00:00") as illustrated in FIG. 4, the internal actuator mechanism activates the revolute joint 28 to pivot the lid 26 down into the closed position over the rim 34. In this embodiment, the lid 26 may be a fixed circular shape and the housing 18 may be a fixed cylindrical shape. The revolute joint 28 shown in FIG. 4 includes the exterior helical gear 42 coupled to the interior actuator mechanism, such that the timer 24 may control the upward and/or downward pivoting movement of the lid 26. Pressing the lid activation button 40 while the lid 26 is in the closed position (e.g., as shown in FIG. 3) may cause the internal actuator mechanism of the timer 24 to engage the helical gear 42 on the revolute joint 28 to pivot the lid 26 to the open position. Alternatively, pressing the lid activation button 40 while the lid 26 is in the open position (e.g., as shown in FIG. 1 or 2) may start and/or stop the clock 46 on the display 36. That is, if the clock 46 is actively counting down, pressing the lid activation button 40 may stop the clock 46. On the other hand, if the clock 46 is stopped, pressing the lid activation button 40 may start the clock 46, thereby continuing the countdown before the lid 26 closes.

Figure 5:
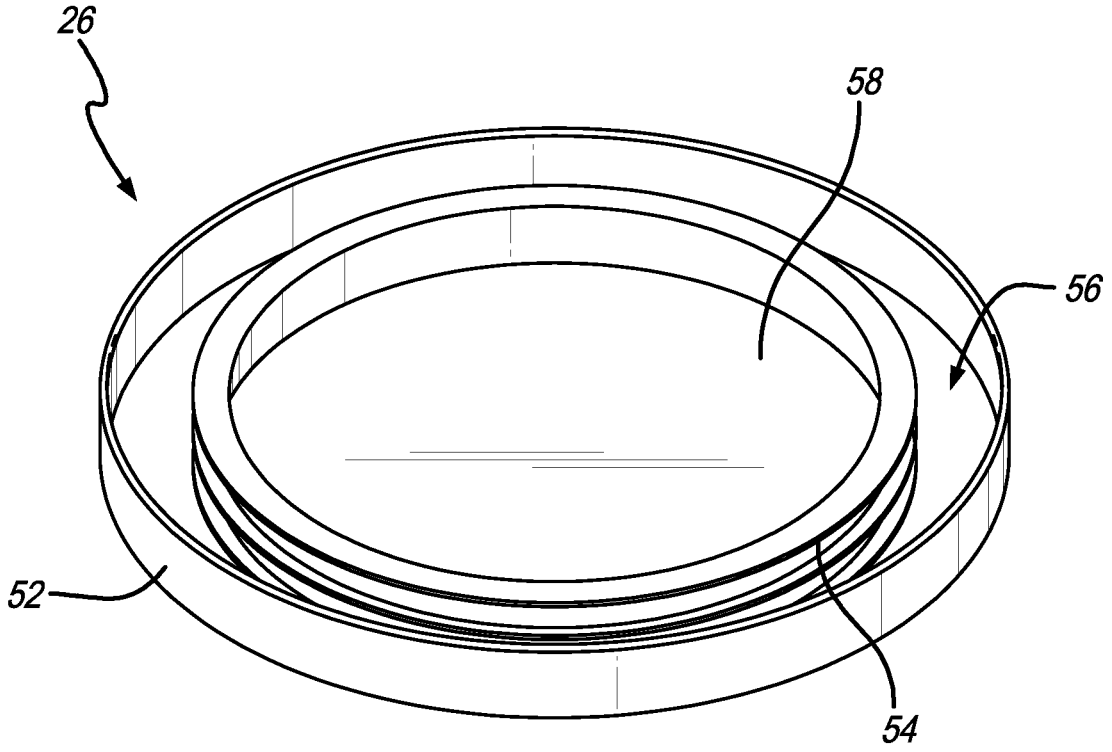
FIG. 5 is a perspective view of an alternative embodiment of the pivoting lid, including an annular channel formed between a relatively rigid circumferential lid wall and an inner flexible annular seal for improved sealing to an upper rim of the candle container.

FIG. 5 is a bottom perspective view of one embodiment of the lid 26 having a size and shape to fit over the rim 34 (shown best in FIGS. 1 and 2) of the housing 18. The lid 26 illustrated in FIG. 5 may include an exterior relatively rigid circumferential lid wall 52 and an inner flexible annular seal 54 that form an annular channel 56 therebetween. The lid 26 illustrated in FIG. 5 may further include a cover 58 that seals off external access to the wick 32, thereby starving the cavity 20 of oxygen when the lid 26 is in the closed position (e.g., as shown in FIG. 3). The timer 24 and the revolute joint 28 may securely attach to any point along the circumferential lid wall 52 to pivot the lid 26 into and out from engagement with the rim 34. In this respect, when in the closed position illustrated in FIG. 3, the rim 34 may extend up into and engage the annular channel 56 for friction fit engagement to form a seal therebetween. The circumferential lid wall 52 may be made from a relatively rigid material of the type and quality to provide a protective outer casing for the relatively pliable material of the inner flexible annular seal 54 within the annular channel 56. This may allow the inner flexible annular seal 54 to conform to the contours of the rim 34, thereby forming a substantial air-tight seal when engaged thereto and more efficiently extinguishing the burning wick 32. Although, the lid 26 may be at least made from fire proof or fire retardant materials to maximize safety because the cover 58 is generally positioned in close proximity to the wick 32, which burns during use.

FIGS. 6 and 7 illustrate an alternative embodiment of the adjustable automatic flame extinguisher 12. In this embodiment, the adjustable automatic flame extinguisher 12 includes an adjustable housing 60 that may increase and/or decrease in diameter (e.g., thereby having a variable cavity 62) and/or height to accommodate a variety of different candle sizes. For example, the sizing of the adjustable automatic flame extinguisher 12 may be manually changed or changed through programming and operation of the timer 24 coupled thereto.

As shown in FIG. 6, the adjustable housing 60 may adjust in height through use of multiple curved telescoping wall segments 64, 64', each including a respective upper segment 66, 66' and a respective lower segment 68, 68' movably interconnected to a medial expansion plate 70, 70'. The upper segments 66, 66' opposite the expansion plates 70, 70' terminate in a segment rim 72, 72', which, in combination, form a variable housing rim 74 (FIG. 7). The height of the adjustable automatic flame extinguisher 12 may be adjusted by moving the upper segments 66, 66' relative to the lower segments 68, 68' about the medial expansion plates 70, 70'. This allows the adjustable housing 60 to accommodate candles of different heights. Moreover, the adjustable housing 60 may be adjusted over time to better form fit to the height of the candle as it shrinks due to burning.

To adjust the diameter of the adjustable automatic flame extinguisher 12, a vertical sliding subduction gap 76 may be disposed between each of the curved telescoping wall segments 64, 64' to allow one curved wall segment (e.g., the wall segment 64) to overlap and slide relative to another of the curved wall segments (e.g., the curved wall segment 64')

to accommodate radial expansion and/or contraction of the adjustable housing 60 relative to an axial center point 78.

In this respect, FIG. 7 more specifically illustrates the full set of the curved wall segments 64, 64', 64", 64'" and the vertical subduction gaps 76, 76', 76", 76'" forming the relatively cylindrical adjustable housing 60. Each of the curved wall segments 64, 64', 64", 64'" may overlap one another when the adjustable housing 60 is contracted toward the axial center point 78, but are narrow enough to still substantially restrict the passage of environmental oxygen into the variable cavity 62 when the lid 26 (or an adjustable lid 80, as illustrated in FIGS. 6 and 7) is closed over the variable housing rim 74. Each of the curved wall segments 64, 64', 64", 64'" essentially form a set of movable platform blades 82, 82', 82", 82'" that separately and articulably connect to an adjustable circumferential inner rim 84. When the adjustable housing 60 contracts, the movable platform blades 82, 82', 82", 82'" slide to overlap one another and rotatably collapse the circumferential inner rim 84 toward the axial center point 78. As such, the diameter of the circumferential inner rim 84 may become smaller. Although, the adjustable automatic flame extinguisher 12 may be configured so the movable platform blades 82, 82', 82", 82'" may not completely collapse on to the axial center point 78 to close the circumferential inner rim 84 (since a usable candle would still have something of a diameter). Upon expansion of adjustable housing 60, the movable platform blades 82, 82', 82", 82'" may rotatably unfurl away from the axial center point 78 and slide outwardly to expand the footprint of the adjustable housing 60, thereby also enlarging the circumferential inner rim 84. The movable platform blades 82, 82', 82", 82'" may overlap each by way of the vertical subduction gaps 76, 76', 76", 76'" to substantially restrict passage of environmental oxygen into the variable cavity 62 regardless of the radial footprint of the adjustable housing 60.

The adjustable lid 80, as shown in FIG. 6 in a general vertical open configuration, may include a set of movable lid blades 86, 86', 86", 86'", each separately and articulably connected to an inner lid cap 88. The diameter of the adjustable lid 80 may be expanded or contracted in a manner similar to that described above with respect to the diameter of the adjustable housing 60. More specifically, the movable lid blades 86, 86', 86", 86'" may slidably overlap each other by way of a set of lid subduction gaps 90, 90', 90", 90'". This allows the adjustable lid 80 to retract or expand the inner lid cap 88, thereby changing the overall diameter of the adjustable lid 80. The exterior helical gear 42 may secure to one of the movable lid blades 86, 86', 86", 86'" such that when the adjustable lid 80 contracts, the exterior helical gear 42 moves in toward the inner lid cap 88. Conversely, when the adjustable lid 80 expands (i.e., the movable lid blades 86, 86', 86", 86'" unfurl from the inner lid cap 88), the helical gear 42 moves further away from the inner lid cap 88. Thus, the adjustable lid 80 may consistently maintain its point of rotational contact relative to the timer 24 and the adjustable housing 60, thereby allowing the adjustable lid 80 to neatly overlap the variable housing rim 74 with an approximately equivalent diameter. The adjustable housing 60 and the adjustable lid 80 may be manually set to a desired size before a candle is placed within the variable cavity 62, and may be further manually adjusted depending on the size, shape, and/or appearance desired.

The base of the adjustable housing 60 may be formed by a set of moveable blades, similar to the movable plate form blades 82, 82', 82", 82'", extending from the bottom of the telescoping curved wall segments 64, 64', 64", 64'" and attaching to a cap similar to the inner lid cap 88 of the adjustable lid 80. This may enable the base of the adjustable housing 60 to expand and contract as the adjustable housing 60 and adjustable lid 80 expand and contract.

The timer 24 illustrated with respect to FIG. 6 similarly includes the display 36 with the clock 46, the hour input button 48, the minute input button 50, and the lid activation button 40. Moreover, the timer 24 may also include a similar internal actuator mechanism for operating movement of the adjustable lid 80, such as by way of the external helical gear 42. The timer 24 may further include an internal power source (e.g., a battery or wire line connection) to operate the respective electrical components. The timer 24 and/or the exterior helical gear 42 may connect to the exterior of one of the curved telescoping wall segments 64, 64', 64", 64'" so that, when the adjustable housing 60 contracts, the timer 24 and/or the exterior helical gear 42 move toward the circumferential inner rim 84, resulting in the housing 60 collapsing on the axial center point 78. Conversely, when the adjustable housing 60 expands (i.e., the curved wall segments 64, 64', 64", 64'" unfurl from the circumferential inner rim 84), the timer 24 and/or the exterior helical gear 42 move further away from the circumferential inner rim 84. Once the size of the adjustable housing 60 and/or the adjustable lid 80 are set and the adjustable automatic flame extinguisher 12 is ready for use, the duration the adjustable lid 80 remains open may be set by way of the timer 24. After activation, the timer 24 counts down to zero, wherein the adjustable lid 80 is moved from the open position to the closed position, wherein the interior of the cavity 20 is deprived of environmental oxygen to help extinguish the wick 32 after a short amount of time, if the wick 32 is still burning.

Figure 8:
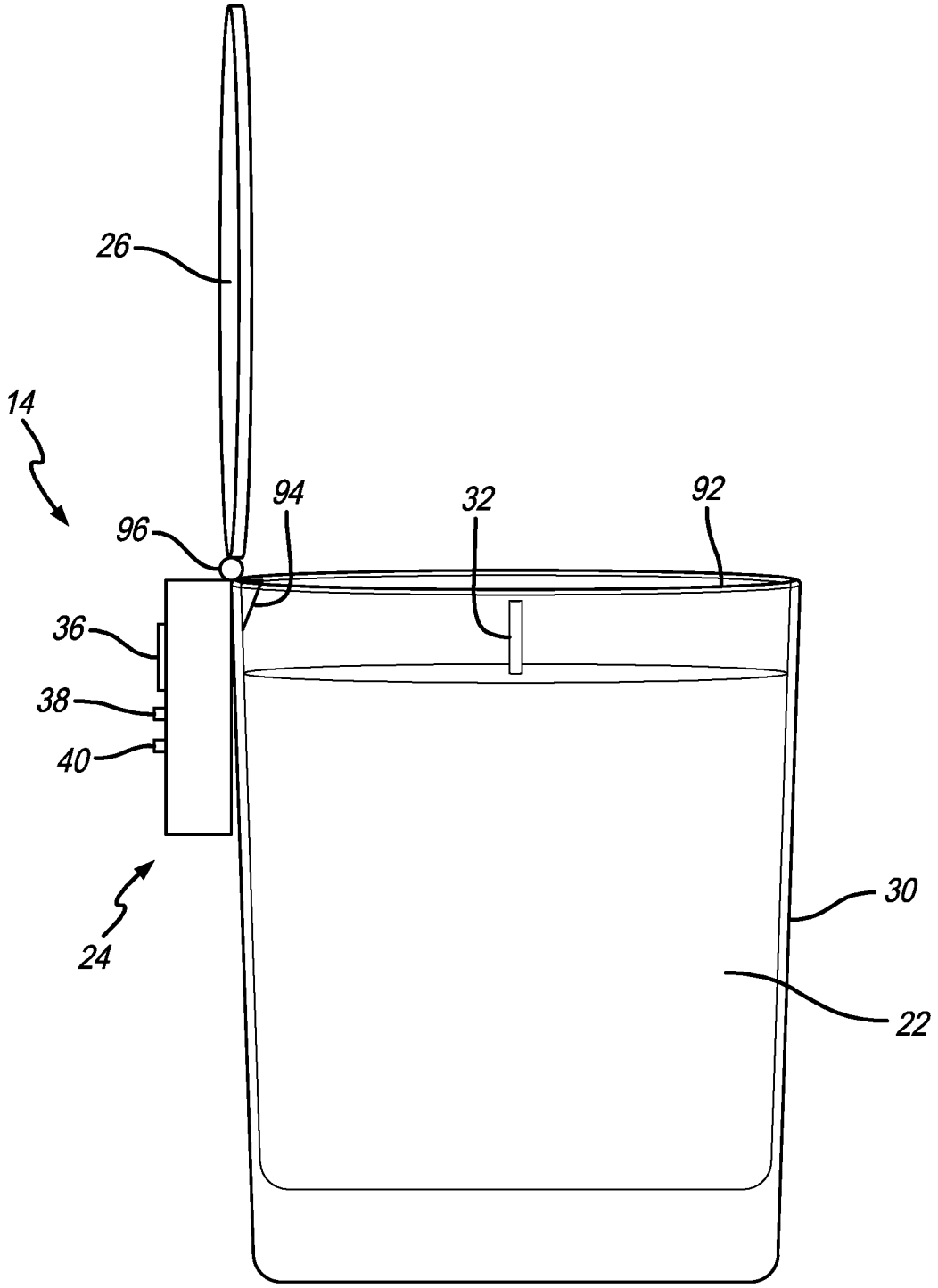
FIG. 8 is a side perspective view of a clip-on automatic flame extinguisher mounted to a candle container with the lid in an open vertical position.
Figure 9:
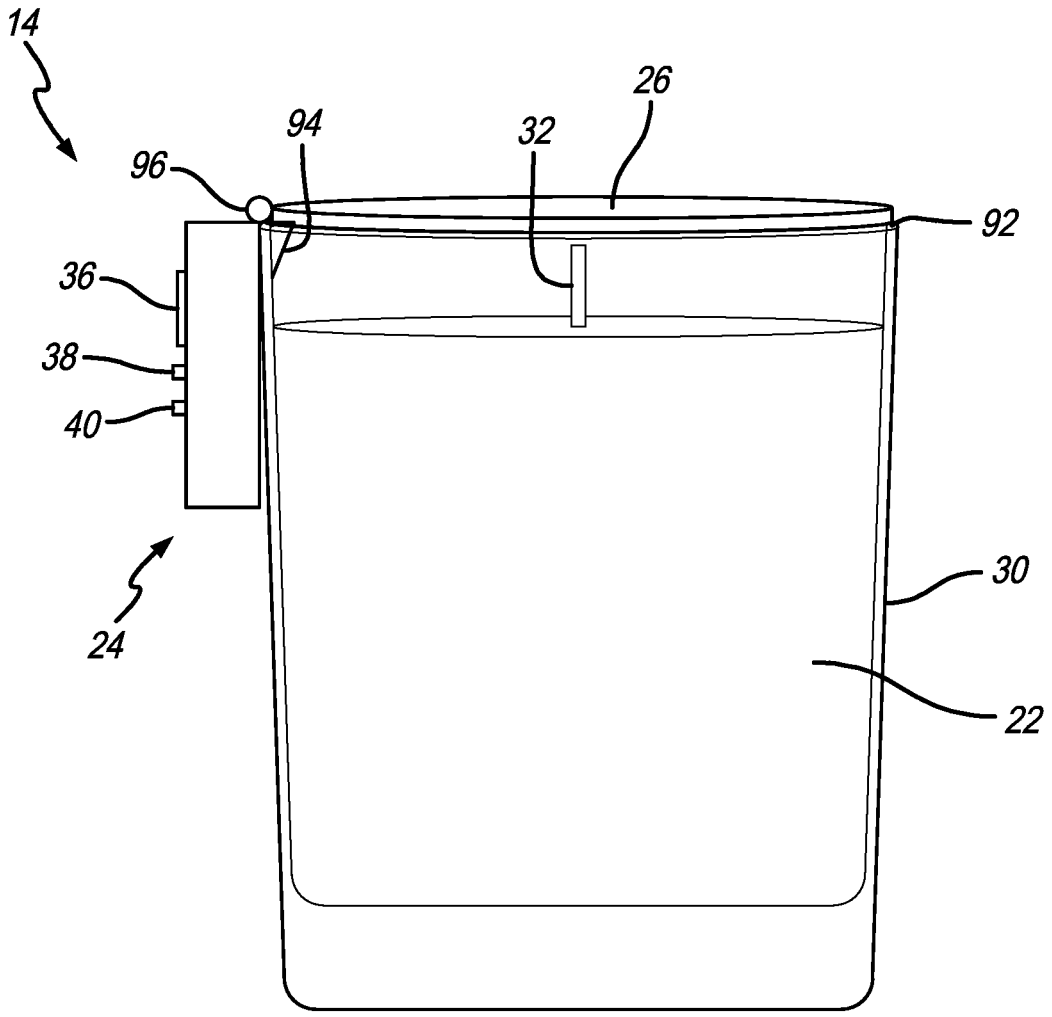
FIG. 9 is a perspective view of the clip-on automatic flame extinguisher of FIG. 8, further illustrating pivoting movement of the lid to a closed position over the candle container.

FIGS. 8 and 9 illustrate an embodiment of the clip-on automatic flame extinguisher 14. In this embodiment, the clip-on automatic flame extinguisher 14 attaches to an upper candle container rim 92 of the container 30 such as by way of a clip 94. As shown, the wick 32 and the wax material of the candle 22 (e.g., the solid fuel mass) are disposed within the container 30 (and below the upper candle container rim 92) such that the clip-on automatic flame extinguisher 14 does not require its own housing (e.g., the housing 18) to operate. The clip 94 may be spring-loaded and attach to the upper candle container rim 92 by compression fit engagement, as generally shown in FIGS. 8 and 9. The clip 94 may also be integrated with the timer 24, which may similarly include the display 36, the input button 38 (which may include one or more of the hour input button 48 and/or the minute input button 50), and the lid activation button 40. In this embodiment, the lid 26 may couple to the timer 24 about a spring-loaded joint 96 rotatably coupled thereto. Similar to the embodiments disclosed above, an internal actuator mechanism may operate the spring-loaded joint 96, such as by way of coiling and/or uncoiling a spring. FIG. 8 illustrates the clip-on automatic flame extinguisher 14 with the lid 26 in a generally vertical and open position, whereas FIG. 9 illustrates the clip-on automatic flame extinguisher 14 with the lid 26 in a closed position covering the upper candle container rim 92.

The timer 24 may be a digital or analog display that indicates the time remaining before the internal actuator mechanism closes the lid 26 onto the upper candle container rim 92. The timer 24 may close the lid 26 by releasing the spring-loaded joint 96 from a locked open position (e.g., shown in FIG. 8), thus allowing the spring within the joint 96 to forcibly pivot the lid 26 down onto the upper candle container rim 92 (e.g., shown in FIG. 9). The speed and/or force of closing the lid 26 may depend on the strength of the spring force exerted by the spring-loaded joint 96.

Moreover, the input button 38 may control the length of time remaining before the spring-loaded joint 96 releases, as disclosed above. The timer 24 may also include the lid activation button 40 that may mechanically raise and/or lower the lid 26 as needed and/or desired. In this way, the timer 24 may activate and raise and/or lower the lid 26 by way of the spring-loaded joint 96 without the need for direct hand manipulation, thus limiting the chance of harmful burns in the event the lid 26 is hot. The clip 94 may be a durable spring tensioner that laterally presses onto an interior sidewall of the container 30. As such, the clip 94 may securely position the timer 24 with respect to the container 30, and may ensure that the lid 26 consistently and completely closes over the upper candle container rim 92. The clip 94 may be outwardly and/or downwardly extendable from the timer 24, and thus adaptable to fit the clip-on automatic flame extinguisher 14 onto a variety of candle containers that vary in size and shape (e.g., height and/or thickness). The spring-loaded joint 96 may be a single revolute joint interconnected with the internal actuator mechanism and/or the lid activation button 40. In this embodiment, e.g., the lid activation button 40 may be a mechanical switch that simply engages and/or disengages the spring-loaded joint 96 and/or the lid 26. In an alternative embodiment, the joint 96 may include exterior threads or grooves that operably mesh with a motorized internal actuator mechanism within the timer 24, thus allowing for electronically-controlled raising and/or lowering of the lid 26 at constant and/or various speeds.

In FIGS. 8 and 9, the lid 26 is illustrated being circular in shape, but the lid 26 may be other shapes known in the art that provide consistent contact with the upper candle container rim 92 when the clip-on automatic flame extinguisher 14 is in the closed position. In one alternative embodiment, the lid 26 may be formed to resemble the lid 26 illustrated in FIG. 5. In another embodiment, the lid 26 may be adjustable in a similar manner as the adjustable lid 80 illustrated and described above with respect to FIGS. 6 and 7. The timer 24 and the lid 26 may be formed from a durable fire-proof or fire retardant material. Alternatively or in addition to, the lid 26 may optionally be insulated to limit heat transfer from the internal cavity 20 to the outer sidewalls of the container 30.

Figure 10:
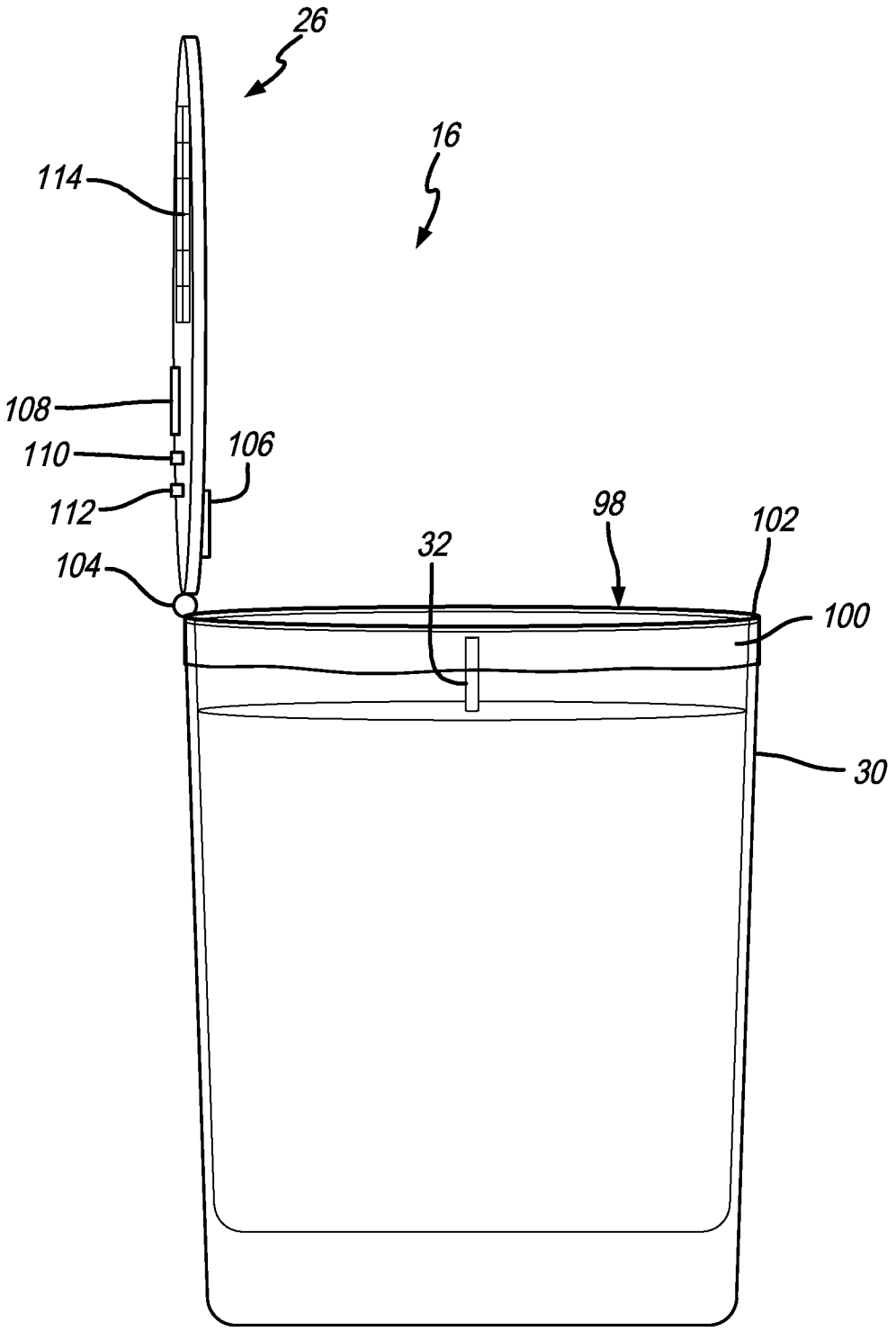
FIG. 10 is a perspective view of an annularly-mounted automatic flame extinguisher annularly mounted to a candle container, with an alternative lid in a vertical open position.
Figure 11:
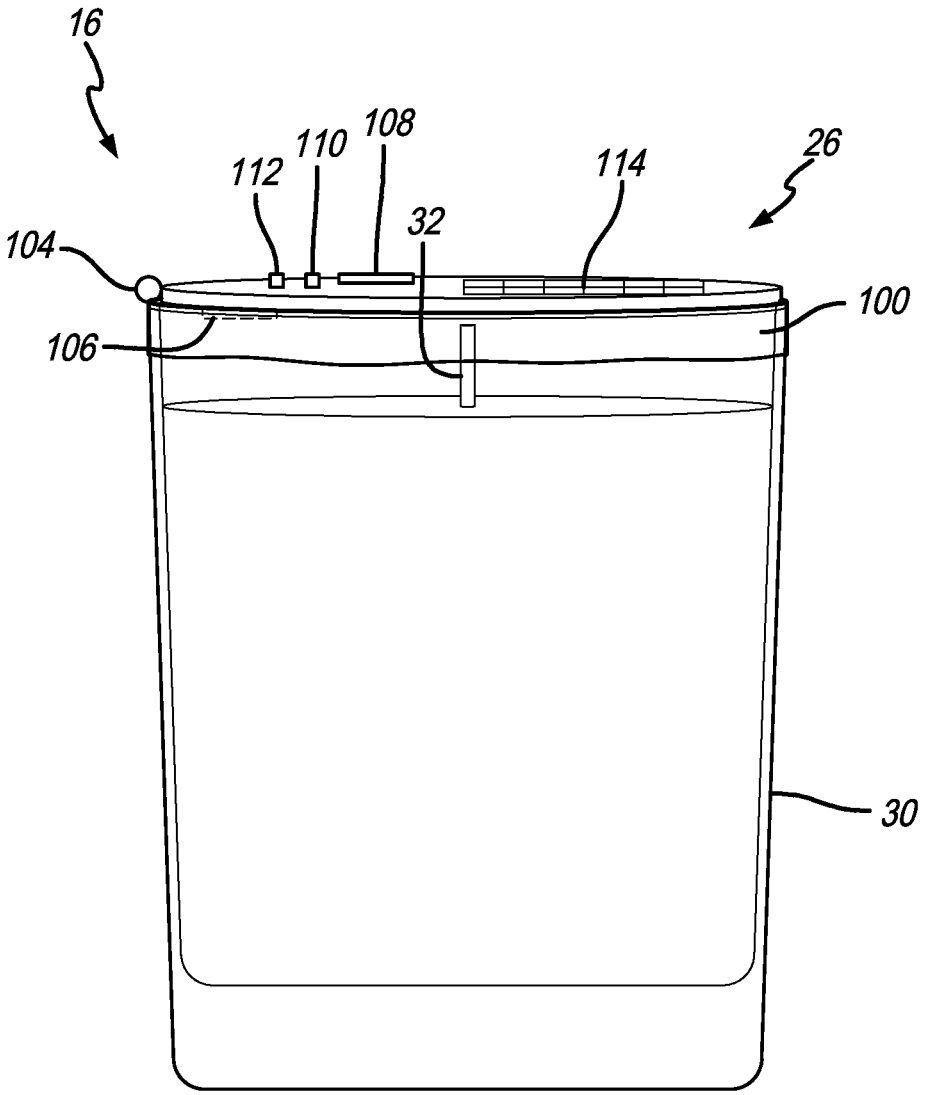
FIG. 11 is a perspective view of the annularly-mounted automatic flame extinguisher of FIG. 10, further illustrating the alternative lid in a horizontal and generally closed position over the candle container.

FIGS. 10 and 11 illustrate another embodiment of the annularly-mounted automatic flame extinguisher 16 mounted on the container 30. The annularly-mounted automatic flame extinguisher 16 may include an annular mounting ring 98 with a circumferential stabilizing wall 100 having an annular upper rim 102 for seated reception of the pivoting lid 26. Furthermore, the annularly-mounted automatic flame extinguisher 16 may include a pivoting joint 104 coupled to the pivoting lid 26 that includes a gear-driven electronic opener 106 coupled thereto. In this embodiment, the operational controls, such a cover display 108, a duration input button 110, an opener 112, and/or a photovoltaic cell 114 (e.g., to generate energy) may be integrated into the pivoting lid 26 as shown. In other embodiments, the pivoting lid 26 may also include a battery to store energy generated by the photovoltaic cell 114. FIG. 10 illustrates the annularly-mounted automatic flame extinguisher 16 with the pivoting lid 26 in a generally vertical open position, whereas FIG. 11 illustrates the same annularly-mounted automatic flame extinguisher 16 with the pivoting lid 26 in a closed position seated on the annular mounting ring 98.

The mounting ring 98 may be formed from a durable fire-proof or fire resistant material, and may rest or otherwise engage the upper candle container rim 92 of the container 30. The circumferential stabilizing wall 100 may also selectively engage the container 30 by way of friction fit, thus further anchoring and sealing the annularly-mounted automatic flame extinguisher 16 onto the container 30. The annular rim 102 may be formed from a durable yet pliant fire-proof or fire resistant material that forms an air-tight seal with the pivoting lid 26 when in the closed configuration shown in FIG. 11. The pivoting joint 104 may secure to the mounting ring 98 apart from the annular rim 102 such that pivoting movement of the pivoting lid 26 does not interfere with the seal between the pivoting lid 26 and the annular rim 102. The mounting ring 98 may have a constant diameter (e.g., to fit a specific diameter upper candle container rim 92) or the mounting ring 98 may have a variable diameter wherein the annularly-mounted automatic flame extinguisher 16 may be used with candle containers having different diameter upper rims (e.g., similar to the embodiments disclosed above with respect to FIGS. 6 and 7). Additionally, the pivoting lid 26 may be made from an insulated and durable fire-proof material and may be formed in a variety of shapes and/or sizes so long as it is able to maintain a relatively tight seal with the annular rim 102. In another embodiment, the pivoting lid 26 may be adjustable, as described above, to accommodate candle containers that vary in size.

The gear-driven electronic opener 106 may be disposed on the side of the pivoting lid 26 closest to the open flame of the container 30, and thus is constructed from a similarly insulated durable fire-proof material that may withstand direct exposure to open flames.

The cover display 108 may provide a digital readout of the time left until the lid 26 pivots from the open position shown in FIG. 10 to the closed position shown in FIG. 11. In an alternative embodiment, the cover display 108 may include an analog indicator showing the time left until the pivoting lid 26 closes onto the mounting ring 98. The duration input button 110 may be used to set and/or extend the duration before the pivoting lid 26 closes onto the annular rim 102. The opener 112 may be used to operate the gear-driven electronic opener 106 to move the pivoting lid 26 to an open position (after being closed), or begin the timer count-down when the pivoting lid 26 is already in the open position. The photovoltaic cell 114 may capture and generate renewable energy (e.g., solar power) to automatically power the gear-driven electronic opener 106 without the need for batteries or the like. Although, the photovoltaic cell 114 may provide power to an internal battery and/or may charge an internal power storage unit within the pivoting lid 26.

In an alternative embodiment, the annularly-mounted automatic flame extinguisher 16 may be entirely mechanically operable, meaning that no electrical energy is needed and/or used to operate the mechanism that causes the pivoting lid 26 to pivot between open and closed positions. Instead of the photovoltaic cell 114, the internal energy storage unit, the gear-driven electronic opener 106, the internal actuator mechanism, and/or the timer 24 could operate entirely on a spring-loaded mechanism similar to that described above in relation to the clip-on automatic flame extinguisher 14 illustrated in FIGS. 8-9.

In another aspect of the embodiments disclosed herein, a remote controller 116 may communicate (e.g., wirelessly or by a wire line connection) with one or more of the automatic flame extinguisher 10, the adjustable automatic flame extinguisher 12, the clip-on automatic flame extinguisher 14, and/or the annularly-mounted automatic flame extinguisher 16 as disclosed herein. More specifically with respect to FIGS. 12 and 13, the remote controller 116 is illustrated having a communication circuit that generates a wireless communication signal 120 (e.g., radio frequency, Bluetooth, Wi-Fi, etc.) for reception by a receiver circuit 122 integrated with, e.g., the timer 24 coupled to the automatic flame extinguisher 10. In one embodiment, the remote controller 116 may communicate with the automatic flame extinguisher 10 via one-way communication, i.e., the wireless communication signal 120 generates from the remote controller 116 for reception only by the receiver circuit 122 mounted within the timer 24. In this embodiment, the remote controller 116 may control certain aspects of the automatic flame extinguisher 10, as described herein, but the automatic flame extinguisher 10 may not be able to communicate information back to the remote controller 116.

Alternatively, the timer 24 may also include a signal generator 124 for generating a responsive signal 126 communicative with the remote controller 116. In this embodiment, the automatic flame extinguisher 10 may be able to communicate certain information (e.g., the "open" or "closed" status of the lid 26) to the remote controller 116. For example, the remote controller 116 may include a Smartphone such that a user is able to check the status of the lid 26 remotely. Additionally, the remote controller 116 may be integrated with other smart home equipment so the user may more easily access and verify the status of the automatic flame extinguisher 10 (e.g., whether the lid 26 is in an "open" or "closed" position). For example, the remote controller 116 may be able to "open" or "close" the lid 26, adjust the time the lid 26 (or the adjustable lid 80) remains in the "open" position (e.g., by remotely adjusting the input button 38, the hour input button 48, and/or the minute input button 50), and adjust the size of the curved telescoping wall segment 64 and/or the adjustable lid 80, with respect to embodiments for the adjustable automatic flame extinguisher 12. Similar features of the timer 24 are also usable with any of the adjustable automatic flame extinguisher 12, the clip-on automatic flame extinguisher 14, and/or the annually mounted automatic flame extinguisher 16. Of course, the remote controller 116 may be controllable by a user, a program that runs automatically, and/or a combination of both.

Figure 12:
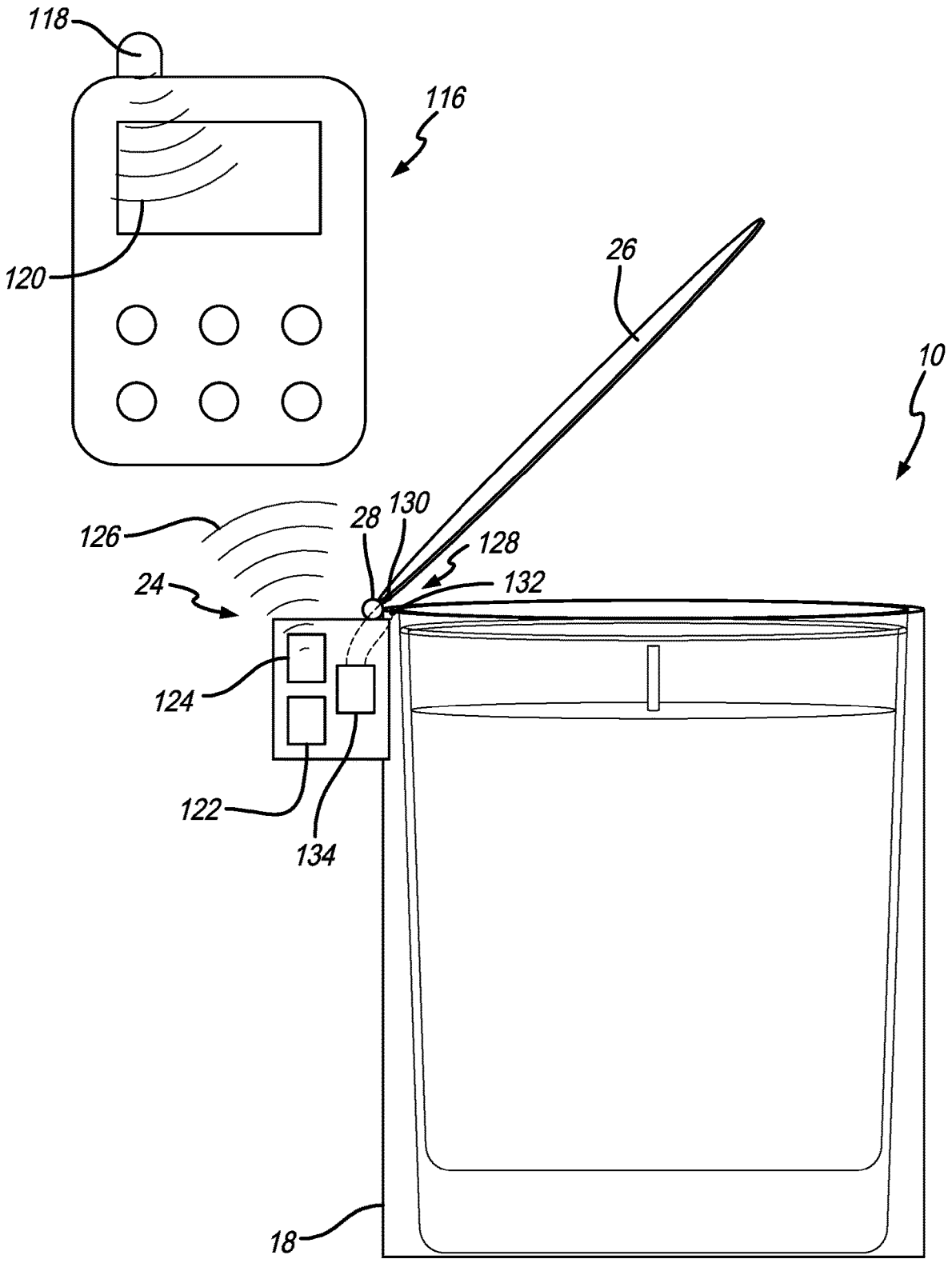
FIG. 12 is a diagrammatic side view of the automatic flame extinguisher in wireless communication with a remote controller.
Figure 13:
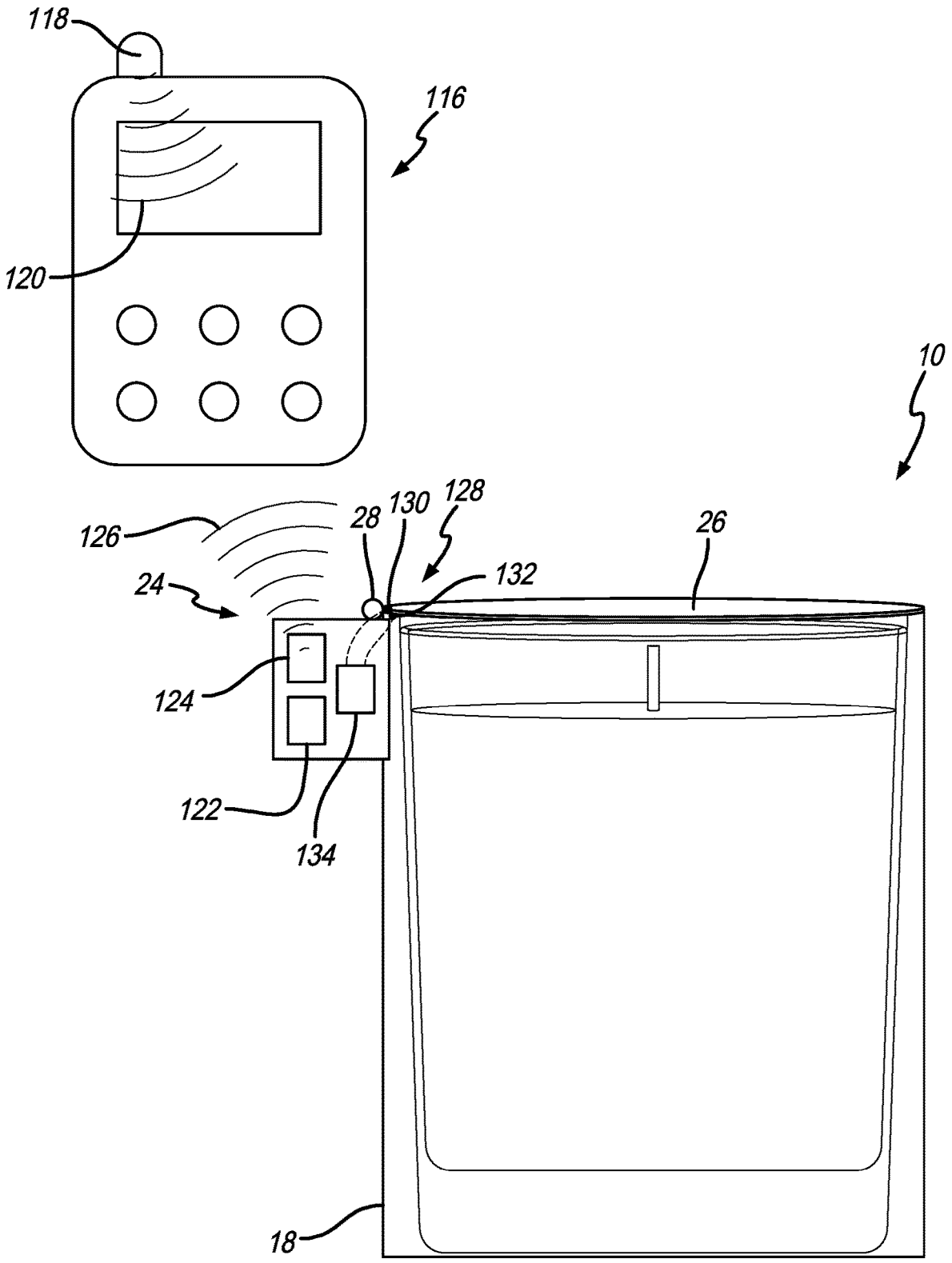
FIG. 13 is a diagrammatic side view of the automatic flame extinguisher similar to FIG. 12, further illustrating wireless communication with the remote controller that the lid is in a "closed" position.

More specifically, FIG. 12 illustrates the lid 26 in an "open" position. Next, the remote controller 116 may generate the wireless communication signal 120 for reception by the receiver circuit 122 embedded within the timer 24. The wireless communication signal 120 may include instructions to move the lid 26 from the "open" position illustrated in FIG. 12 to the "closed" position illustrated in FIG. 13. In this respect, after receiving the wireless communication signal 120, the timer 24 may activate and pivot the lid 26 according to the embodiments disclosed herein. An indicator switch 128 may include a lid lead 130 and a housing lead 132 that may couple to circuitry within the interior of the timer 24 to provide information back to the remote controller 116, such as a sensor 134, regarding the "open" or "closed" status of the lid 26. More specifically, as illustrated in FIG. 12, each of the lid lead 130 and the housing lead 132 are in non-contact relation with one another. Here, the timer 24 may relay information back to the remote controller 116 by way of the signal generator 124 and the responsive signal 126 that the lid 26 is in an "open" position. Although, in FIG. 13, the lid lead 130 contacts the housing lead 132 when the lid 26 pivots to the "closed" position as shown therein. Here, the timer 24 may relay the "closed" status of the lid 26 to the remote controller 116 by way of the responsive signal 126. This way, the user of the remote controller 116 may immediately identify the "open" or "closed" status of the lid 26 in real-time.

Figure 14:
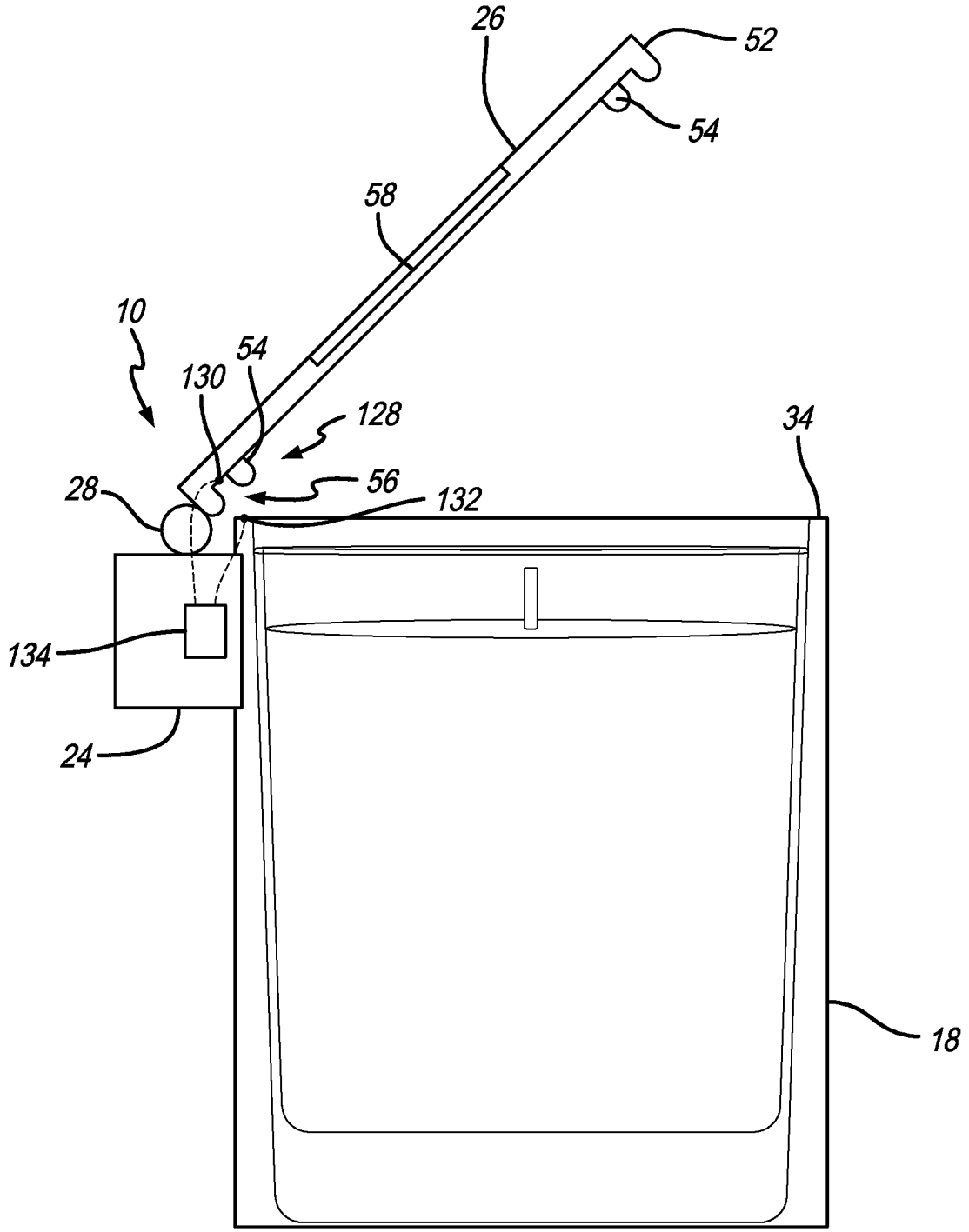
FIG. 14 is a side view of the automatic flame extinguisher similar to that of FIGS. 1-3 and 12-13, further illustrating an indicator switch in a non-contact position when the lid is open.
Figure 15:
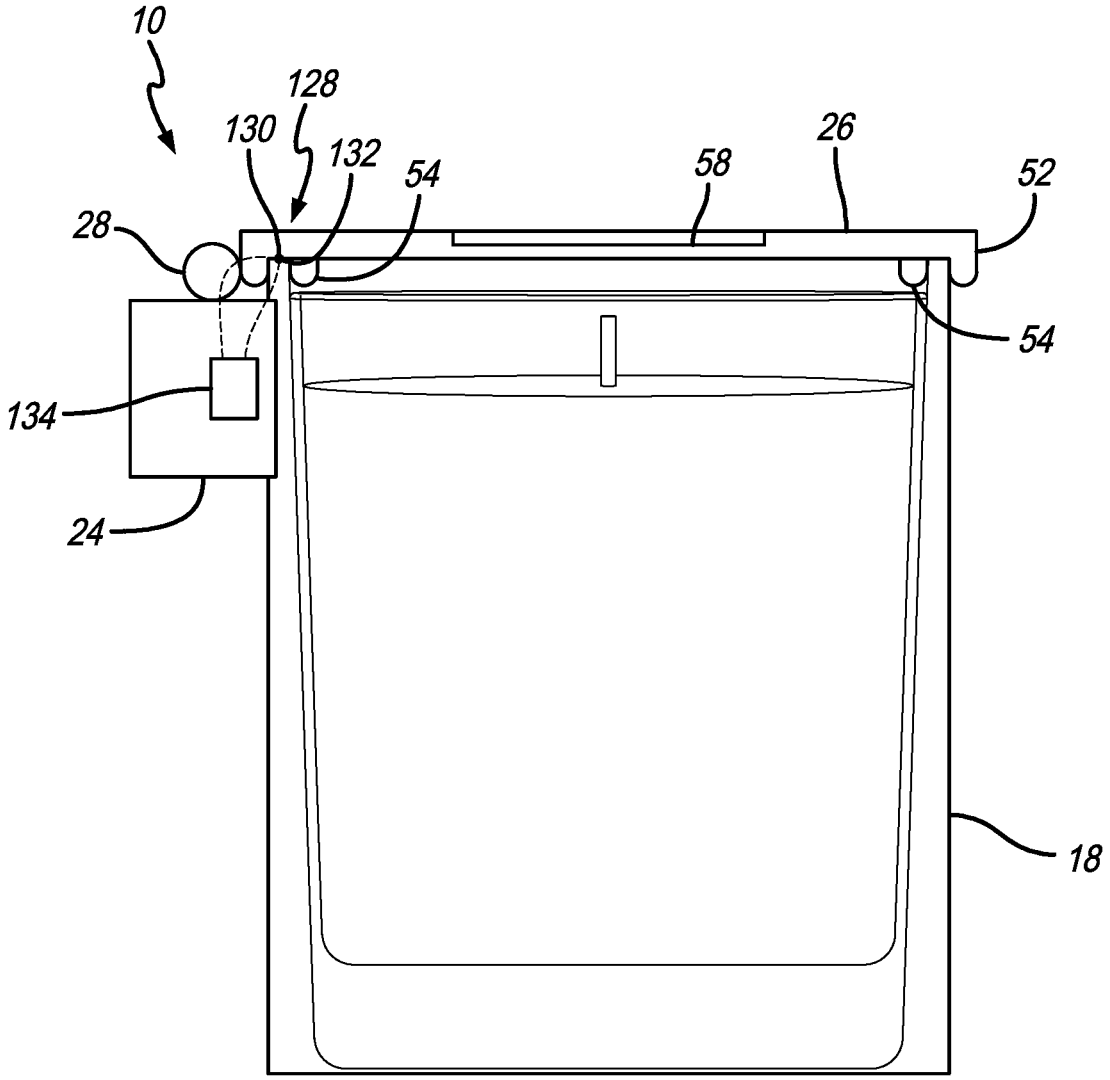
FIG. 15 is a side view of the automatic flame extinguisher similar to FIG. 14, further illustrating the indicator switch in a contact position when the lid is closed.

In an alternative embodiment, as shown in FIGS. 14 and 15, an indicator switch 128 may also be used with the lid 26 as illustrated with respect to FIG. 5 above. Here, the lid lead 130 may be positioned within the annular channel 56 (FIG. 14). The housing lead 132 may be positioned on the rim 34 of the housing 18 and be positioned underneath the lid lead 130 when the lid 26 pivots to the closed position illustrated in FIG. 15. When the lid 26 is in the "open" position illustrated in FIG. 14, each of the lid lead 130 and the housing lead 132 may be exposed and in non-contact relation relative to one another. When the lid 26 pivots to the "closed" position illustrated in FIG. 15, the exposed lid lead 130 and the exposed housing lead 132 may make contact with one another and complete a circuit that relays a signal back to the sensor 134 that the lid 26 is now in the "closed" position. The timer 24 may relay the status to the remote controller 116 as described herein. Similarly, when the lid lead 130 and the housing lead 132 do not complete a circuit when the lid 26 is in an "open" position, the sensor 134 may identify said "open" position and the timer 24 may relay the same to the remote controller 116, as described above.

Figure 16:
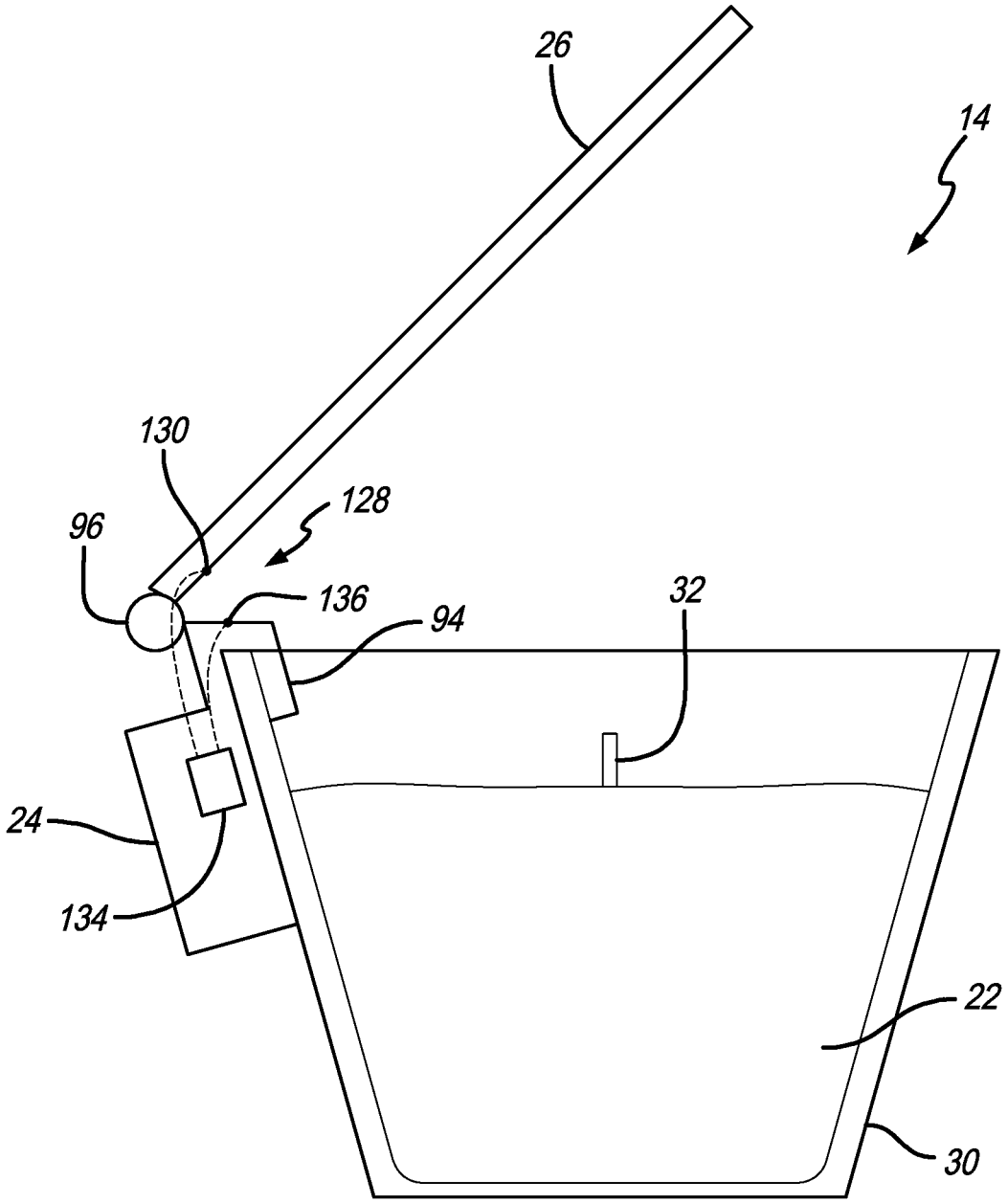
FIG. 16 is a side view of the clip-on automatic flame extinguisher similar to that of FIGS. 8-9, further illustrating the indicator switch in a non-contact position when the lid is open.
Figure 17:
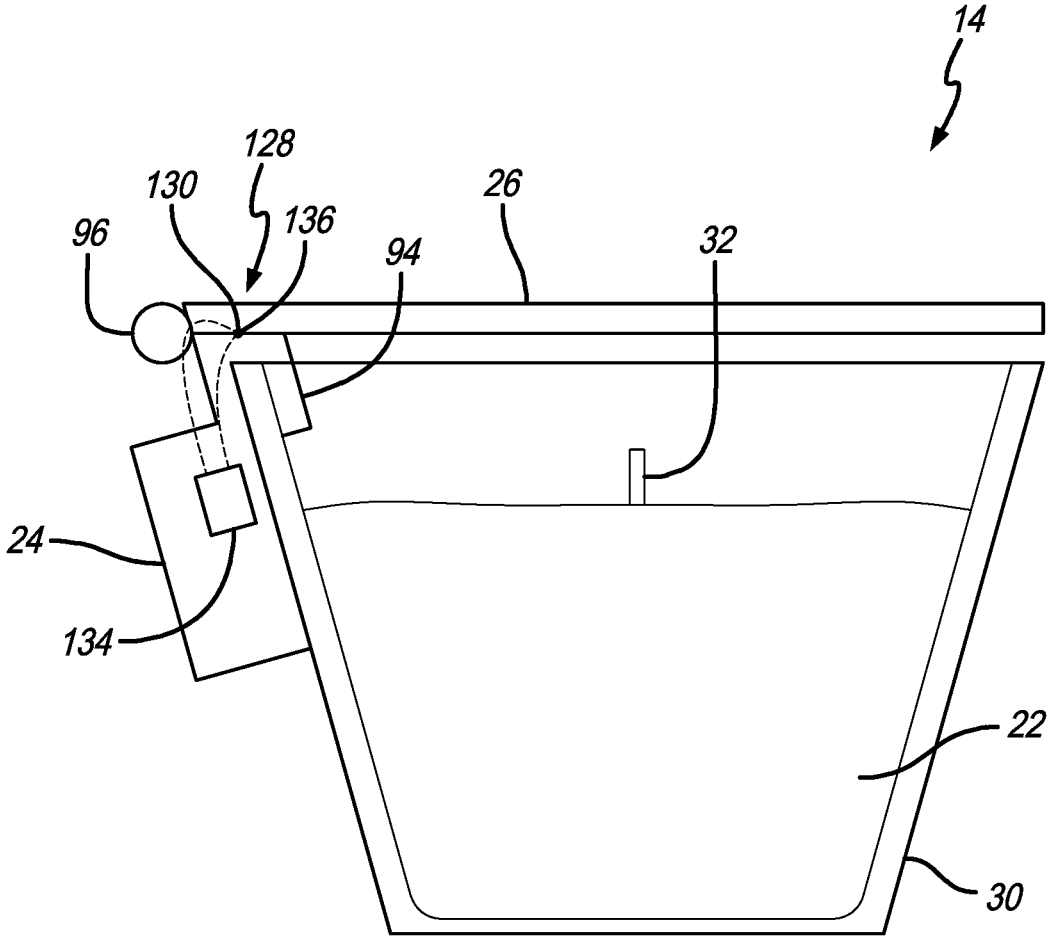
FIG. 17 is a side view of the clip-on automatic flame extinguisher similar to FIG. 16, further illustrating the indicator switch in a contact position when the lid is closed.
Figure 18:
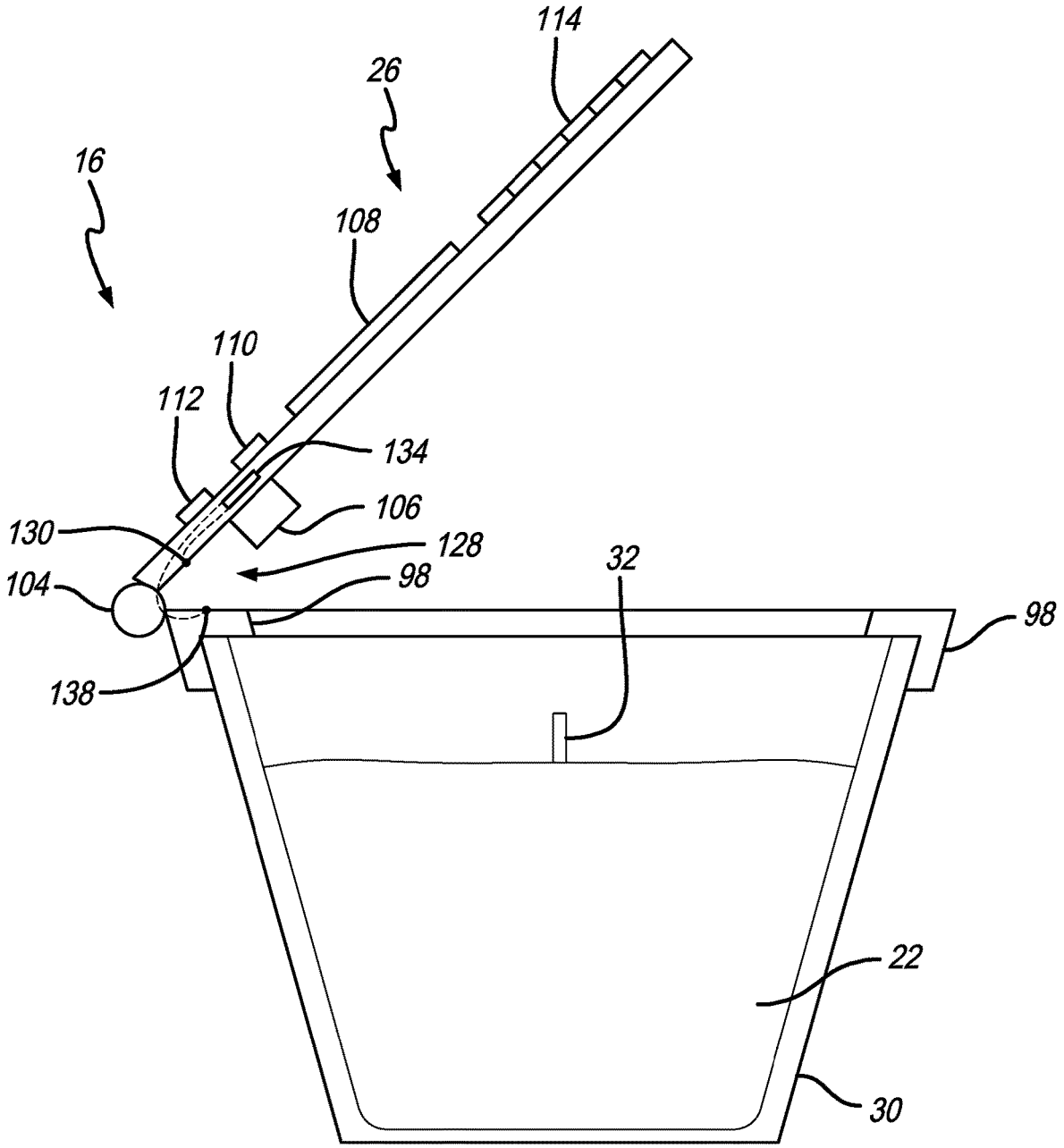
FIG. 18 is a side view of the annularly mounted automatic flame extinguisher similar to that of FIGS. 10-11, further illustrating the indicator switch in a non-contact position when the lid is open.
Figure 19:
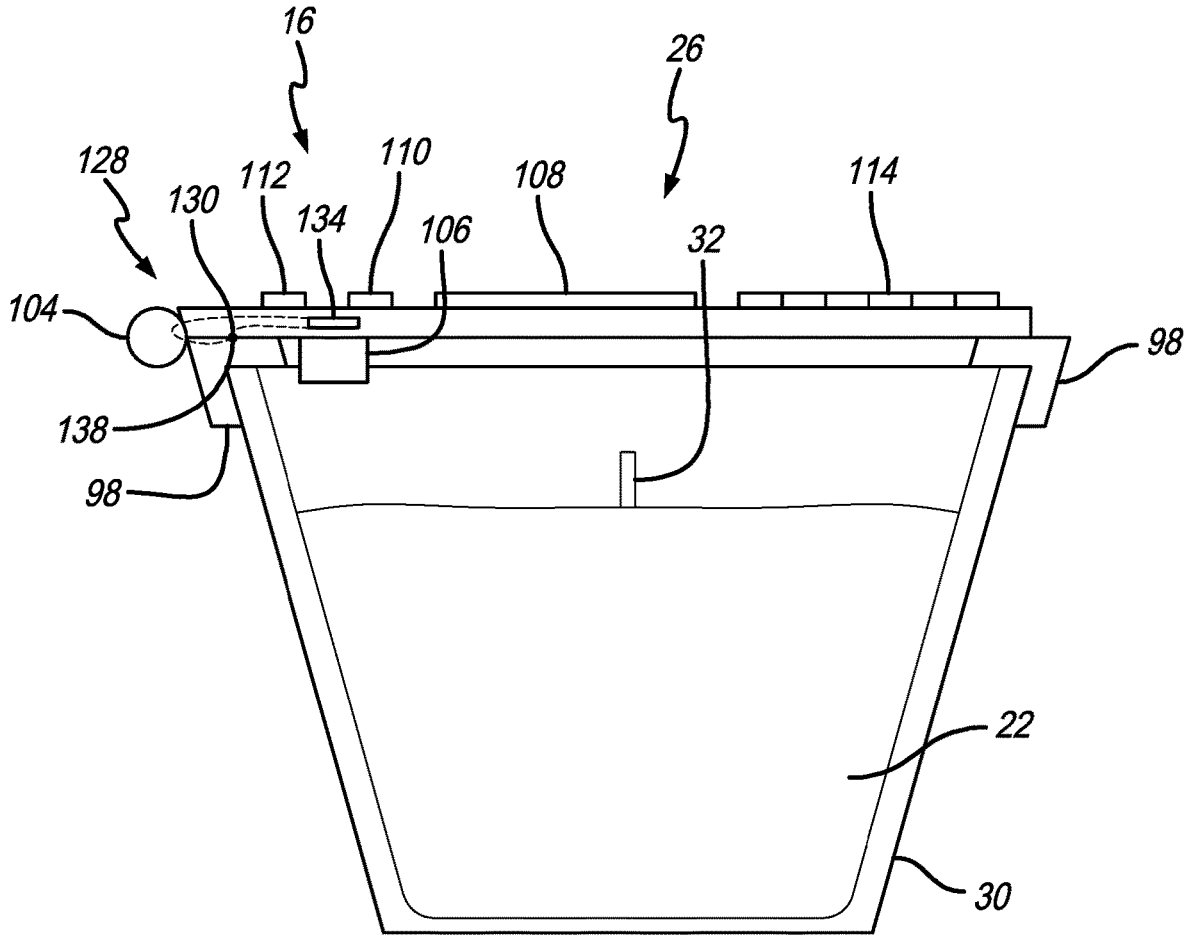
FIG. 19 is a side view of the annularly mounted automatic flame extinguisher similar to FIG. 18, further illustrating the indicator switch in a contact position when the lid is closed.

FIGS. 16-19 further illustrate integration of the indicator switch 128 and the sensor 134 with respect to the clip-on automatic flame extinguisher 14 (FIGS. 16-17) and the annularly-mounted automatic flame extinguisher 16 (FIGS. 18-19). More specifically, FIGS. 16-17 illustrate a similar embodiment where in the clip-on automatic flame extinguisher 14 includes the timer 24 housing the sensor 134. As shown, the sensor 134 also couples to the lid lead 130 positioned up underneath the lid 26, as described above. Although, in this embodiment, the automatic flame extinguisher 14 clips to the container 30 (i.e., there is no housing 18), so the sensor electrically couples to a clip lead 136 coupled to the clip 94 and exposed for contact with the lid lead 130. In this respect, pivoting the lid 26 from the "open" position illustrated in FIG. 16 to the closed position illustrated in FIG. 17 causes the lid lead 130 to contact the clip lead 136, thereby completing a circuit therein. This, of course allows the sensor 134 to identify that the lid 26 is, in fact, in the "closed" position. Integrating the clip lead 136 with the clip 94 may provide for a compact and portable version of the clip-on automatic flame extinguisher 14 usable with a variety of candles 22, as opposed to needing to separately wire the lid lead 130 and/or the housing lead 132/the clip lead 136 for each deployment.

Similarly, FIGS. 18-19 illustrate that the lid 26 of FIGS. 10-11 may include a similar compact design wherein the indicator switch 128 includes the lid lead 130 coupled to the lid 26 as described above, and a ring lead 138 coupled to a portion of the annular mounting ring 98. Here, the ring lead 138 is generally positioned underneath the lid lead 130 for contact thereof once the lid 26 pivots to the "closed" position illustrated in FIG. 19, similar to the embodiments discussed herein with respect to FIGS. 12-17. Additionally, in this embodiment, the sensor 134 may be integrated with the lid 26 as illustrated in FIGS. 18-19. To this end, the annularly-mounted automatic flame extinguisher 16 may include communication circuitry that allows the annularly-mounted automatic flame extinguisher 16 to communicate with, e.g., the remote controller 116, such as by wireless communication and/or wireline communications as disclosed herein.

Figure 20:
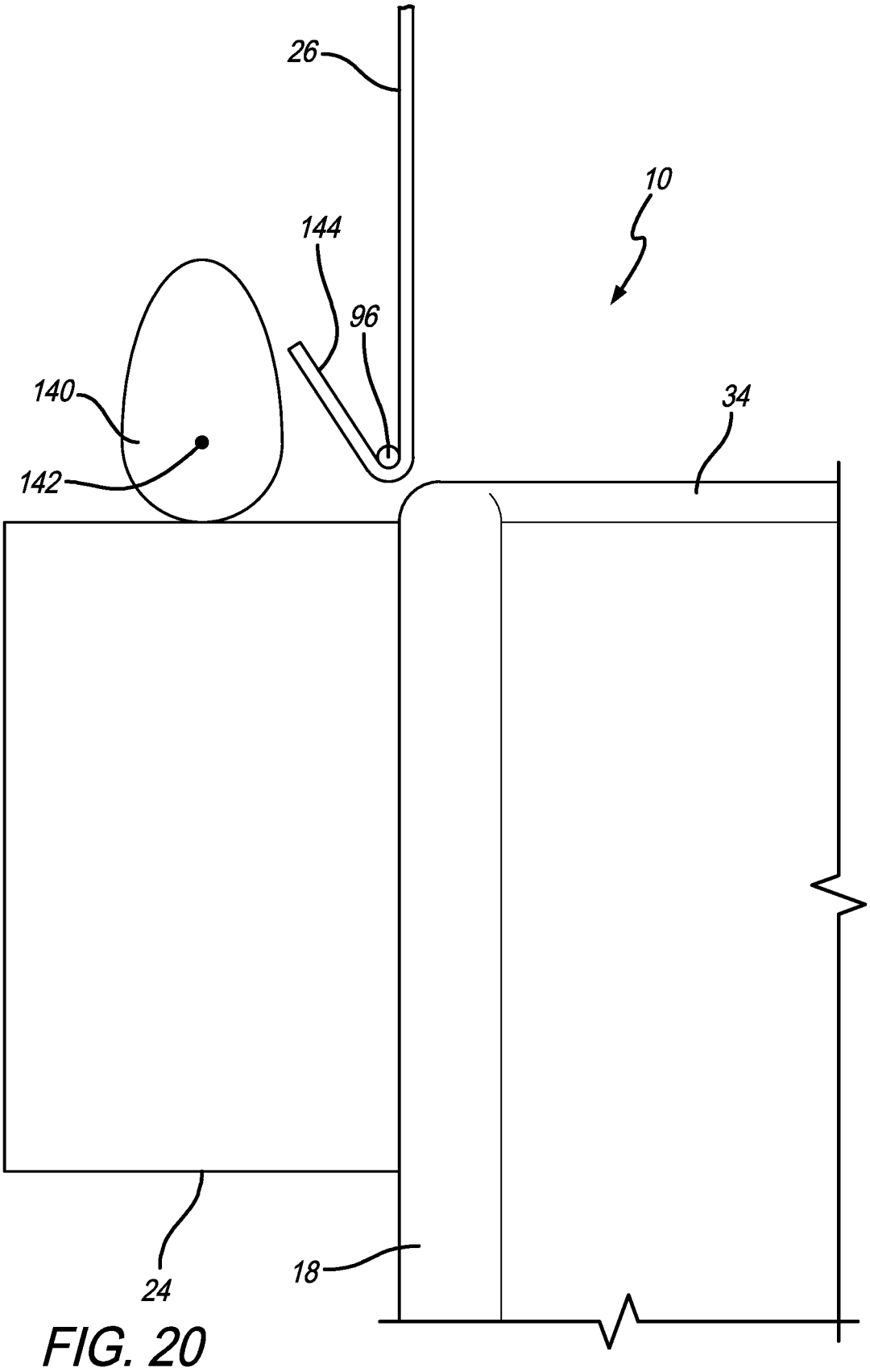
FIG. 20 is an enlarged side view of a cam positioned in initial non-contact relation relative to an actuator level.
Figure 21:
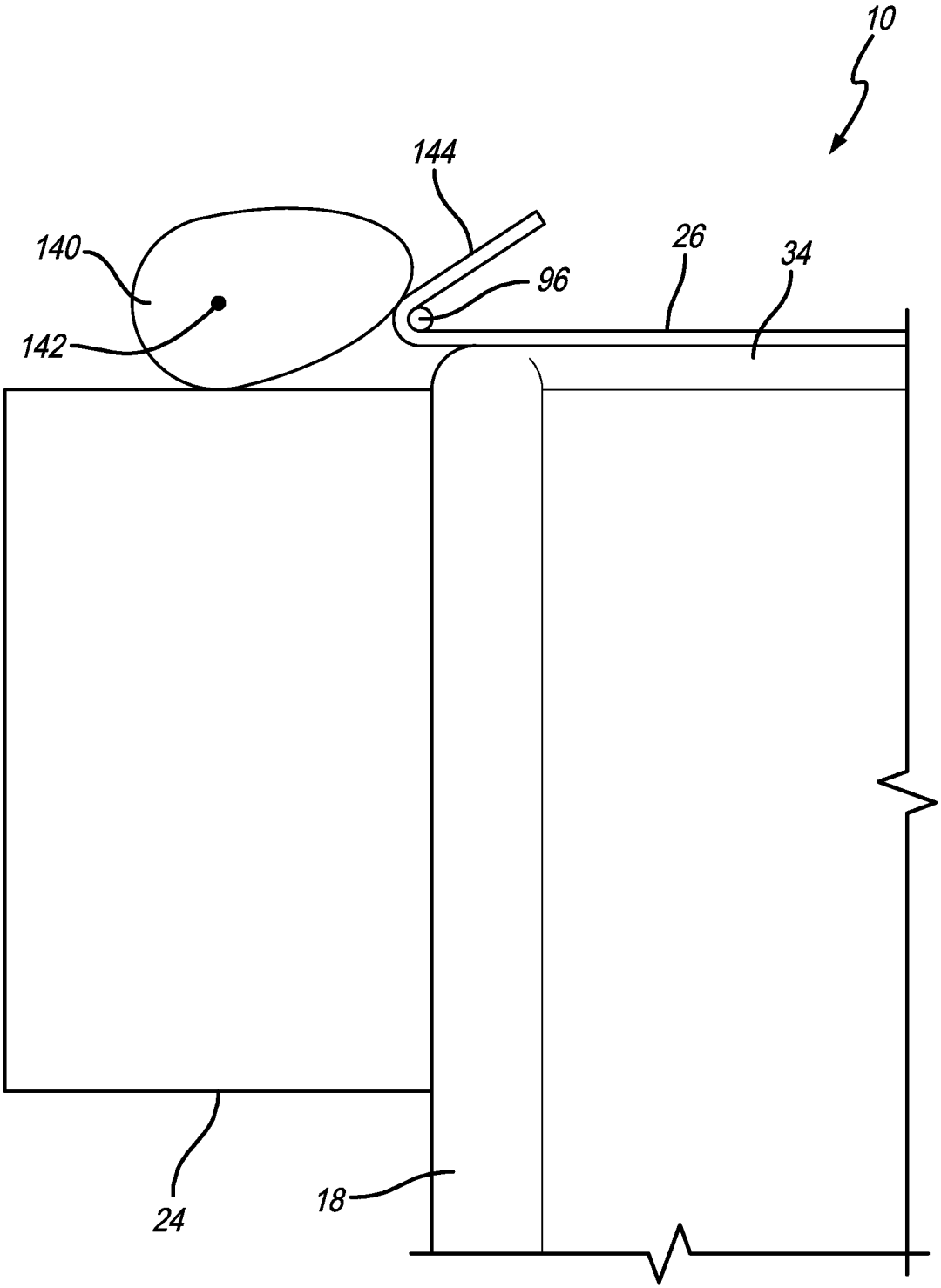
FIG. 21 is an enlarged side view of the cam illustrated in FIG. 20, further illustrating pivoted engagement of the cam with the actuation level to reposition the lid into the closed position.

In another aspect of the features disclosed herein, the timer 24 may house a cam 140 that acts as a timing and/or actuating mechanism for the lid 26 (or the adjustable lid 80). The cam 140 may be translationally fixed within the timer 24 at an axis of rotation 142. The cam 140 may be motorized or spring loaded to enable rotation about the axis 142; and the cycle time of the cam 140 may be set as a function of the time the lid 26, 80 is to stay open. In FIG. 20, the oblong shape of the cam 140 is illustrated in spaced and non-contact relation with a spring-loaded actuation lever 144. Initially, the lid 26 is in a generally vertical position, held open by the spring-loaded joint 96. The actuation lever 144 couples to the lid 26 at an angle so that the oblong cam 140 may protrude outward from the timer 24 and into contact with the actuation lever 144, as shown by the rotational progression from FIG. 20 to FIG. 21. As such, in FIG. 21, the cam 140 rotates approximately 90 degrees into contact with the actuation lever 144, thereby causing the lid 26 to pivot about (and against) the spring-loaded joint 96. Such rotational movement of the cam 140 causes the actuation lever 144 to pivot the lid 26 to the "closed" position illustrated in FIG. 21. Thereafter, the cam 140 may rotate back to the position illustrated in FIG. 20, thereby allowing the spring-loaded joint 96 to pivot the lid 26 back to the generally vertical and "open" position. Of course, the cam 140 could with other lids as disclosed herein, including the adjustable lid 80.

Figure 22:
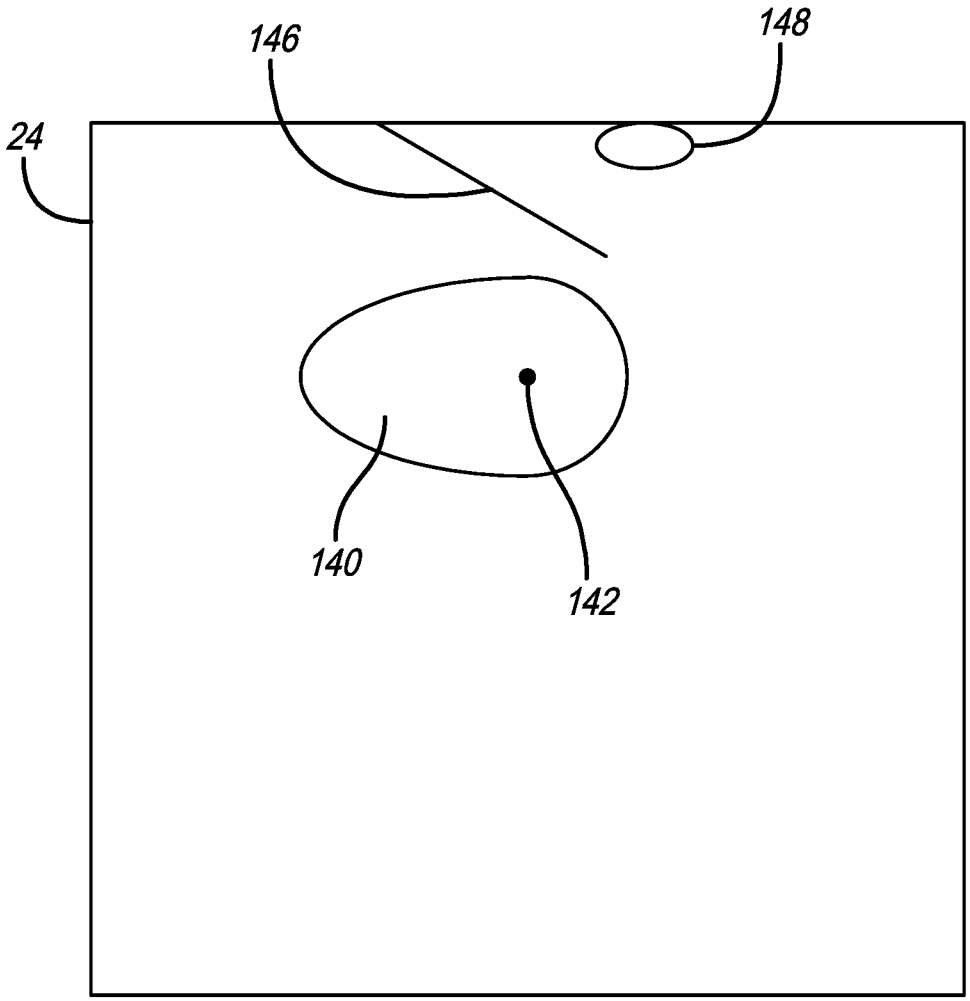
FIG. 22 is an enlarged side view of another embodiment of a cam in non-contact relation relative to a switch that activates a mechanical or electrical contact switch.
Figure 23:
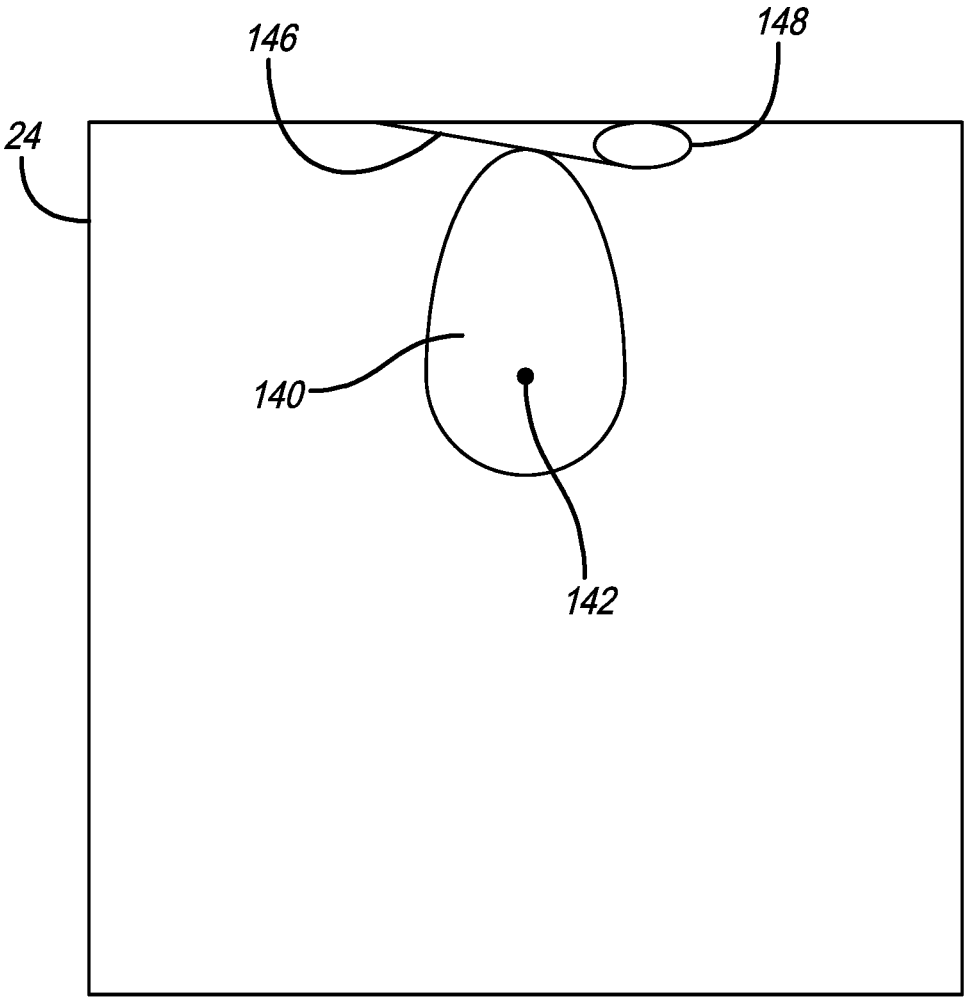
FIG. 23 is an enlarged side view of the alternative cam of FIG. 22, further illustrating engagement of the activation switch with the contact.

In an alternative embodiment, FIGS. 22-23 illustrate that the cam 140 housed within the timer 24 may be used to activate a switch 146 that electrically activates mechanical rotation or pivoting movement of the spring-loaded joint 96 to pivot the lid 26 to the "closed" position. In FIGS. 22-23, the cam 140 is located inside the timer 24 along with the switch 146. Pivoting the cam 140 from the generally horizontal and non-contact position illustrated in FIG. 22 to that of the generally vertical position illustrated in FIG. 23 causes the oblong cam 140 to engage and push the switch 146 into engagement with a contact 148. In one embodiment, the contact 148 may be a mechanical switch wherein, when the switch 146 meets the contact 148, the contact 148 mechanically causes the spring-loaded joint 96 to pivot the lid 26 to the "closed" position, similar to that described above with respect to FIGS. 22-23. Alternatively, the contact 148 may be an electrical switch wherein, when the switch 146 meets the contact 148, the contact 148 completes a circuit within the timer 24 that electrically causes the lid 26 to pivot to the "closed" position.

Figure 24:
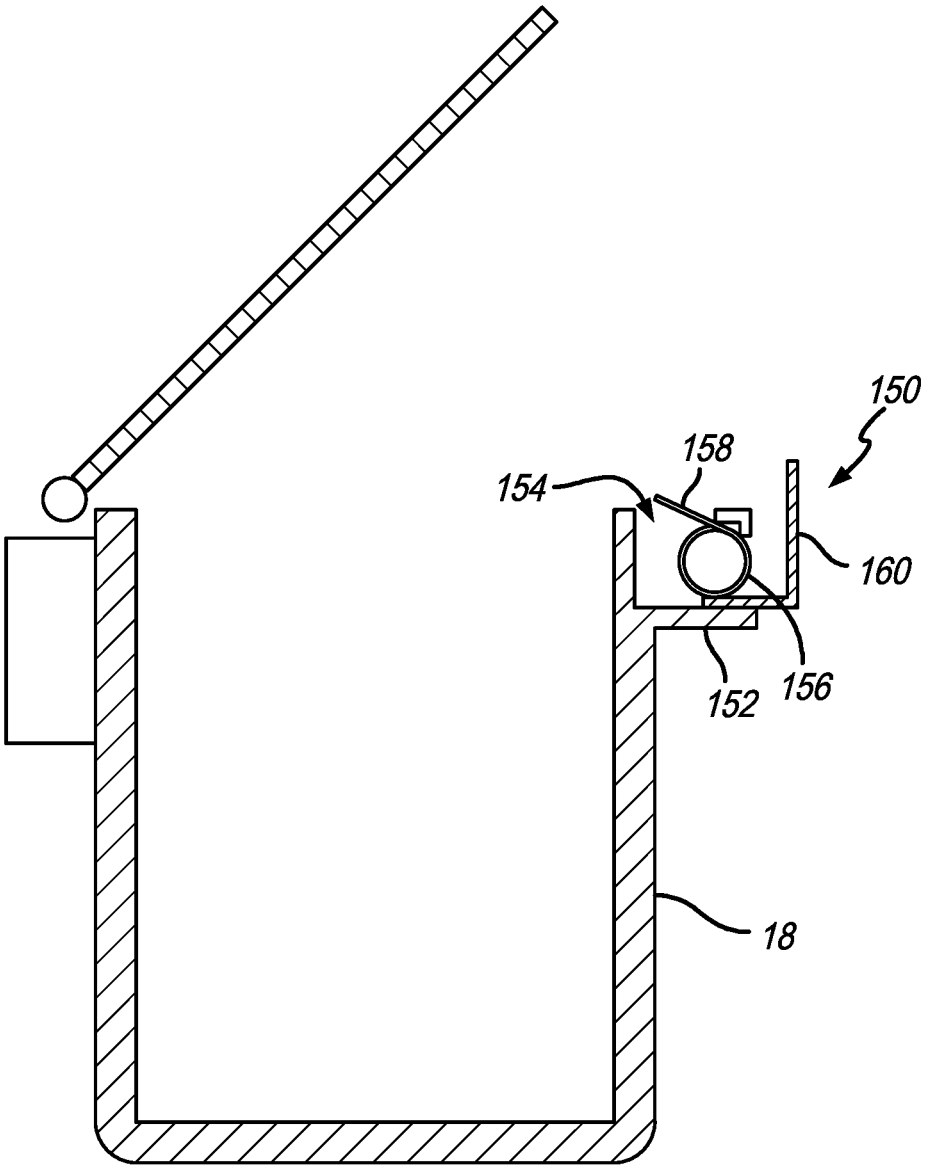
FIG. 24 is a partial cut-away side view of a lid lock in a position unlocked position.
Figure 25:
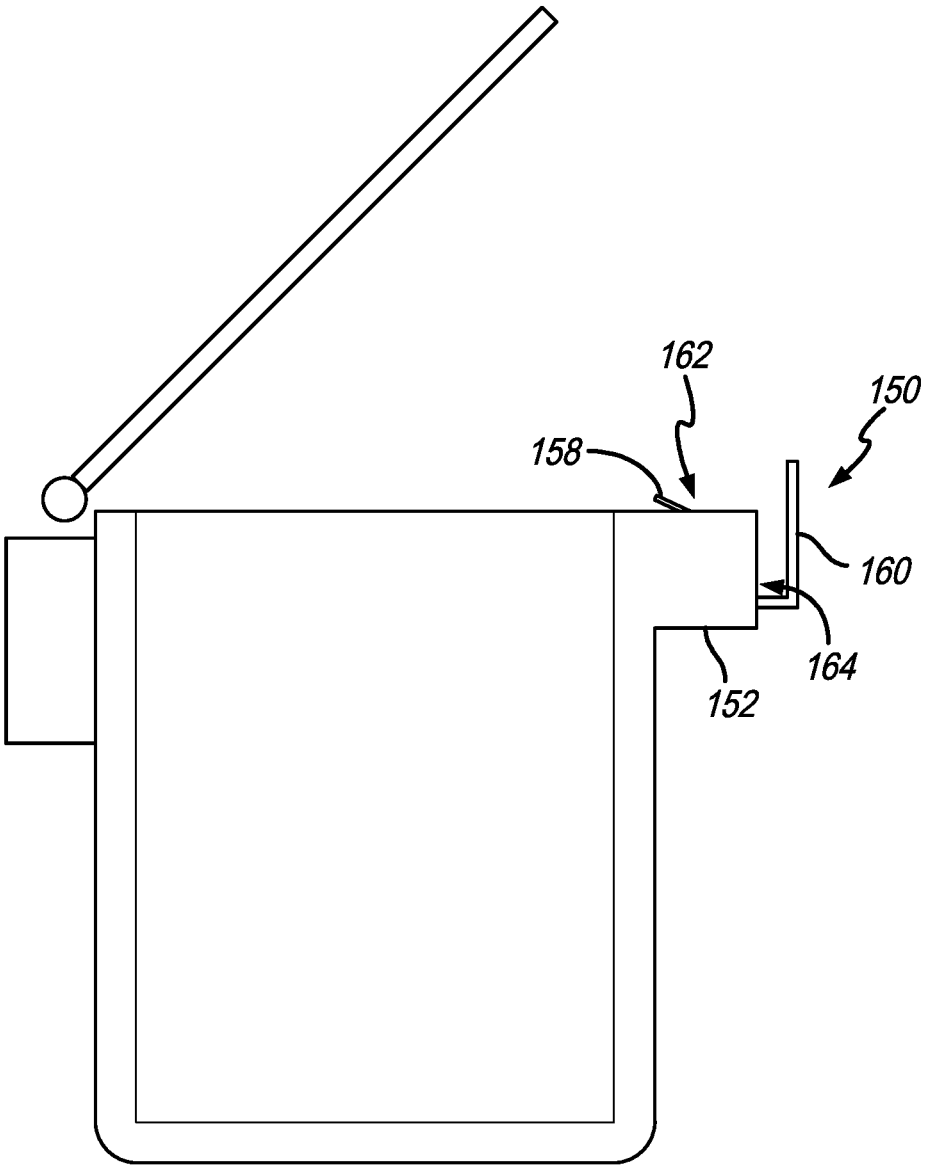
FIG. 25 is a side view of the lock of FIG. 24, further illustrating extension of a pin and a latch from a lock housing.
Figure 26:
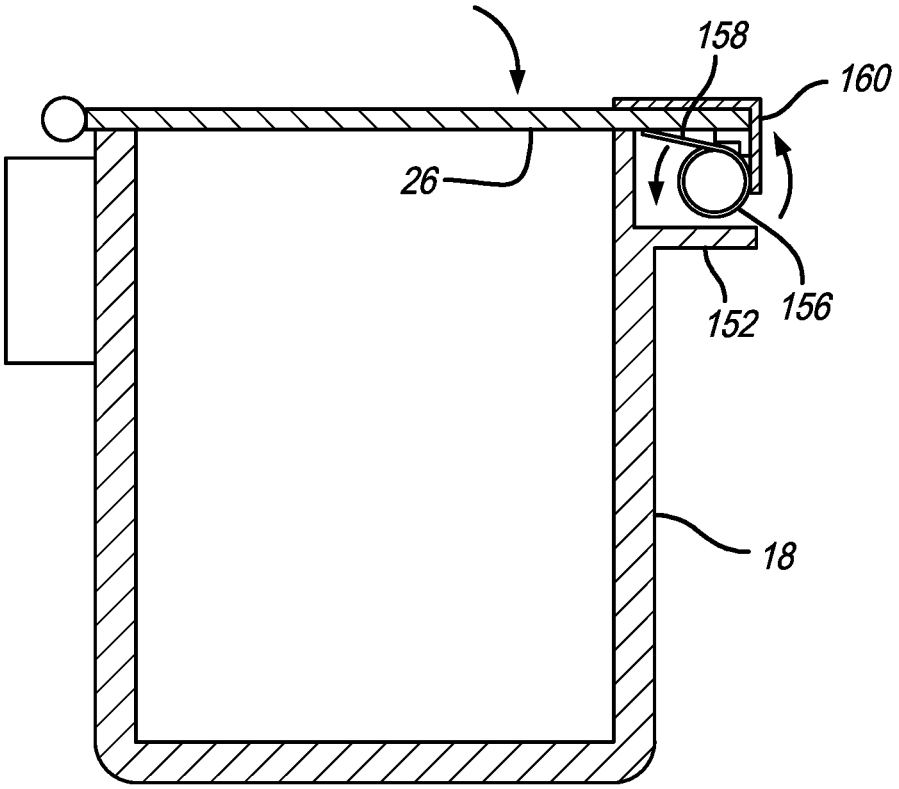
FIG. 26 is a partial cut-away side view similar to FIG. 24, further illustrating pivoted engagement of the latch overlying the lid when in the closed position, thereby locking the lid.

In an alternative embodiment, a locking mechanism may be used to ensure that the lid 26 remains in the "closed" position in the event it is desired to extinguish the candle 22. Such a locking mechanism may provide enhanced safety with respect to any of the automatic flame extinguisher 10, the adjustable automatic flame extinguisher 12, the clip-on automatic flame extinguisher 14, and/or the annularly-mounted automatic flame extinguisher 16 since the lid 26 may have a greater propensity to remain in the "closed" position (e.g., in the event the candle 22 is inadvertently tipped over). In one embodiment as shown in FIGS. 24-26, a lock 150 includes a lock housing 152 and a lock cavity 154 within the housing 152. The lock housing 152 may couple to the housing 18 as shown in FIGS. 24-26, although in other embodiments the lock housing 152 may attach to the adjustable housing 60 or the annular mounting ring 98. A wheel 156 within the lock cavity 154 may attach to a pin 158 and a latch 160. The pin 158 may protrude out of an upper opening 162 (FIG. 25) of the housing 152 and the latch 160 may protrude out of a lateral or side opening 164 of the housing 152, as best shown in FIG. 25. In this respect, FIG. 25 best illustrates the outward projection of each of the pin 158 and the latch 160 from the enclosed housing 152, whereas FIGS. 24 and 26 are partial cut-away views illustrating internal operation thereof.

In operation, initially as illustrated in FIG. 24, the lid 26 is in an "open" position (not shown in FIG. 24) relative to the 18. Here, the lock 150 is unlocked. As illustrated in FIG. 26, when the lid 26 rotates or pivots to the "closed" position relative to the housing 18, the bottom of the lid 26 engages the pin 158, thereby pushing the pin downwardly relative to its position illustrated in FIG. 24. As such, the wheel 156 coupled thereto rotates counter-clockwise in response, thereby also repositioning the latch 160 from the configuration illustrated in FIGS. 24-25 to the position illustrated in FIG. 26, i.e., generally positioned over the lid 26. Covering the lid 26 in this manner may help prevent rotation of the lid 26 from the "closed" position illustrated in FIG. 26 back toward the "open" position. To unlock the lid 26, the user may rotate the latch 160 about the wheel 156 in a clockwise direction to move the latch 160 from a position overlying the lid 26 so that the lid 26 may pivot back into the "open" position. Once disengaged, the pin 158 again protrudes out from the top of the lock housing 152. Of course, the lock 150 could be used with any of the embodiments as disclosed herein, and persons of ordinary skill in the art may recognize that other locking mechanisms may be used to help ensure that the lid 26 remains in the "closed" position once activated to snuff out a burning wick 32.

Although several embodiments have been described in detail for purposes of illustration, various modifications may be made without departing from the scope and spirit of the invention. Accordingly, the invention is not to be limited, except as by the appended claims.

What is claimed is:

1. An automatic flame extinguisher, comprising:

a base for positioning the automatic flame extinguisher in relation to a candle, the base comprising an elongated cylindrical container having a size and shape for select reception and retainment of the candle therein and including a plurality of telescoping wall segments for selectively changing a height of the cylindrical container, wherein the cylindrical container further includes a plurality of curved wall segments with a vertical subduction gap in between respective adjacent curved wall segments, each of the plurality of curved wall segments being selectively slidable relative to one another in overlapping relationship about the respective subduction gaps for inward and/or outward radial translation to vary an internal diameter of the cylindrical container;

a lid coupled to the base about a pivot, the lid being selectively positionable between a first open position and a second closed position to extinguish a burning wick of the candle; and a timer including a clock for selectively activating the pivot to reposition the lid from the first open position to the second closed position after the clock reaches a threshold operation time.

2. The automatic flame extinguisher of claim 1, wherein the elongated container includes an upper rim having a size and shape for selectively receiving the lid for seated reception thereon when in the second closed position, the container and the lid cooperating to substantially close an interior of the container from atmosphere to starve the burning wick of oxygen.

3. The automatic flame extinguisher of claim 1, wherein the plurality of telescoping wall segments each include an upper segment selectively movable relative to a lower segment about a medial expansion plate.

4. The automatic flame extinguisher of claim 1, wherein the base includes a plurality of movable platform blades each separately and articulably coupled to an adjustable inner rim of the base.

5. The automatic flame extinguisher of claim 4, including a plurality of subduction gaps positioned generally between each of the plurality of movable platform blades, the subduction gaps permitting selective sliding movement of adjacent movable platform blades in an overlapping relationship relative to one another.

6. The automatic flame extinguisher of claim 1, wherein the lid includes a plurality of movable lid blades each separately and articulably coupled with a lid cap and movable relative to one another to vary a diameter of the lid.

7. The automatic flame extinguisher of claim 1, wherein the base, the lid, and the timer comprise a flame resistant material or a heat insulative material.

8. The automatic flame extinguisher of claim 1, wherein the base includes a spring-loaded clip attachable to the candle.

9. The automatic flame extinguisher of claim 1, wherein the base comprises an annular mounting ring having an upper surface generally complimentary with the lid for seated reception thereon and an internal channel having a size and shape for select compression fit engagement with an upper rim of a container retaining the candle.

10. The automatic flame extinguisher of claim 1, wherein the pivot comprises a revolute joint or a helical gear actuable by the timer in response to the clock reaching the threshold operation time.

11. The automatic flame extinguisher of claim 1, wherein the timer comprises a hand-operable timer or an electronic timer operable via an externally accessible input.

12. The automatic flame extinguisher of claim 1, wherein the timer includes a display showing an elapsed time or the threshold operation time.

13. The automatic flame extinguisher of claim 1, wherein the timer includes a lid activation button for selectively positioning the lid between the first open position and the second closed position.

14. The automatic flame extinguisher of claim 1, wherein the lid includes an inner annular seal comprising a flexible material selectively form fitting to an upper rim of a container of the candle and cooperating therewith to seal the candle from atmosphere when the lid is in the second closed position.

15. The automatic flame extinguisher of claim 14, including a transparent cover generally positioned to an interior of the inner annular seal for viewing a wick of the candle when the lid is in the second closed position.

16. The automatic flame extinguisher of claim 1, including a remote controller communicatively coupled with the timer in operable relation relative thereto.

17. The automatic flame extinguisher of claim 1, including an indicator switch for identifying whether the lid is in the first open position or the second closed position.

18. The automatic flame extinguisher of claim 17, wherein the indicator switch includes a first lead generally exposed underneath the lid and a second lead generally exposed thereunder and in non-contact relation relative thereto when the lid is in the first open position and in contact relation relative thereto when the lid is in the second closed position.

19. The automatic flame extinguisher of claim 17, including a sensor coupled with the indicator switch and in communication with the timer.

20. The automatic flame extinguisher of claim 18, wherein the second lead generally couples with the base, a rim of a container housing the candle, a clip coupling the base to the rim of the container housing the candle, or an annular mounting ring.

21. The automatic flame extinguisher of claim 1, including a lock retaining the lid in the second closed position.

22. The automatic flame extinguisher of claim 21, wherein the lock includes a housing retaining a rotatable wheel coupled with an upwardly extending lever and a latch, the upwardly extending lever actuable by the lid about the wheel when pivoted to the second closed position, the wheel simultaneously rotating the latch into an overlying position relative to the lid to lock the lid in the second closed position.

23. The automatic flame extinguisher of claim 1, including a solar panel coupled with the lid and providing electrical energy to the timer.

24. The automatic flame extinguisher of claim 1, wherein the pivot comprises a cam actuable by the timer in response to the clock reaching the threshold operation time, the cam being movable between a disengaged position in non-contact relation relative to an actuation lever when the lid is in the first open position and an engaged position contacting the actuation lever to reposition the lid in the second closed position.

25. The automatic flame extinguisher of claim 24, wherein the activation lever comprises an electrically conductive material that selectively couples with an electrical contact triggering repositioning of the lid to the second closed position.

26. An automatic flame extinguisher, comprising:

a base for positioning the automatic flame extinguisher in relation to a candle;

a lid coupled to the base about a pivot, the lid being selectively positionable between a first open position and a second closed position to extinguish a burning wick of the candle;

a timer including a clock for selectively activating the pivot to reposition the lid from the first open position to the second closed position after the clock reaches a threshold operation time; and a lock having a housing retaining a rotatable wheel coupled with an upwardly extending lever and a latch, the upwardly extending lever actuable by the lid about the wheel when pivoted to the second closed position, the wheel simultaneously rotating the latch into an overlying position relative to the lid to lock the lid in the second closed position.

27. An automatic flame extinguisher, comprising:

a base for positioning the automatic flame extinguisher in relation to a candle;

a lid coupled to the base about a pivot, the lid being selectively positionable between a first open position and a second closed position to extinguish a burning wick of the candle; and a timer including a clock for selectively activating the pivot by a cam actuable by the timer in response to the clock reaching a threshold operation time, to reposition the lid from the first open position to the second closed position after the clock reaches the threshold operation time, the cam being movable between a first retracted position when the lid is in the first open position and an advanced position when the lid is in the second closed position in response to an actuation level comprising an electrically conductive material that selectively couples with an electrical contact triggering repositioning of the lid from the first open position to the second closed position.

* * * * *